US011220105B2

(12) United States Patent
Arakane

(10) Patent No.: US 11,220,105 B2
(45) Date of Patent: Jan. 11, 2022

(54) LIQUID DISCHARGE APPARATUS

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/824,251

(22) Filed: Mar. 19, 2020

(65) Prior Publication Data

US 2020/0298554 A1 Sep. 24, 2020

(30) Foreign Application Priority Data

Mar. 20, 2019 (JP) ..... JP2019-052467

(51) Int. Cl.
*B41J 29/393* (2006.01)
*B41J 2/045* (2006.01)

(52) U.S. Cl.
CPC ..... *B41J 2/0451* (2013.01); *B41J 2/04581* (2013.01)

(58) Field of Classification Search
CPC ..... B41J 2/165; B41J 29/393; B41J 2/04581
See application file for complete search history.

(56) References Cited

U.S. PATENT DOCUMENTS 8,226,193 B2 7/2012 Sugahara
9,073,725 B2 7/2015 Arakane
9,156,249 B1 * 10/2015 Sato ..... B41J 2/04581
9,956,772 B2 5/2018 Arakane et al.
2007/0046715 A1 * 3/2007 Yamanobe ..... B41J 29/393 347/19
2010/0045716 A1 2/2010 Sugahara
2011/0227988 A1 * 9/2011 Yamazaki ..... B41J 29/393 347/19
2014/0085369 A1 * 3/2014 Allworth ..... B41J 2/16579 347/14
2015/0029254 A1 1/2015 Arakane
2017/0282549 A1 10/2017 Arakane et al.

FOREIGN PATENT DOCUMENTS

JP 2007-160802 A 6/2007
JP 2010-069872 A 4/2010
JP 2011-148112 A 8/2011
JP 2015-024601 A 2/2015
JP 2017-177774 A 10/2017

* cited by examiner

*Primary Examiner* — Lam S Nguyen
(74) *Attorney, Agent, or Firm* — Banner & Witcoff, Ltd.

(57) ABSTRACT

There is provided a liquid discharge apparatus including a conveyer, a head, a carriage, and a controller. The controller is configured to: record an image on a recording medium by executing a recording operation and a conveyance operation; obtain discharge-defective nozzle information; set, as a plurality of specified nozzles, the discharge-defective nozzle and all the nozzles disposed at an upstream side in a conveyance direction from the discharge-defective nozzle, or the discharge-defective nozzle and all the nozzles belonging to the nozzle row and disposed downstream of the discharge-defective nozzle in the conveyance direction, based on the discharge-defective nozzle information obtained, and use any other nozzle than the specified nozzles in the recording operation.

15 Claims, 12 Drawing Sheets

CASE IN WHICH INK IS REQUIRED TO BE DISCHARGED FROM DISCHARGE DEFECTIVE NOZZLE WHEN DISCHARGE DEFECTIVE NOZZLE IS USED

CASE IN WHICH INK IS NOT REQUIRED TO BE DISCHARGED FROM DISCHARGE DEFECTIVE NOZZLE WHEN DISCHARGE DEFECTIVE NOZZLE IS USED

CASE IN WHICH NO CONVEYANCE ERROR IS CAUSED IN COMPARATIVE EXAMPLE

- ○ USE NOZZLE (NORMAL NOZZLE)
- ● NON-USE NOZZLE (DISCHARGE DEFECTIVE NOZZLE)
- ● NON-USE NOZZLE (NORMAL NOZZLE)

CASE IN WHICH CONVEYANCE ERROR IS CAUSED IN COMPARATIVE EXAMPLE

- ○ USE NOZZLE (NORMAL NOZZLE)
- ● NON-USE NOZZLE (DISCHARGE DEFECTIVE NOZZLE)
- ● NON-USE NOZZLE (NORMAL NOZZLE)

CASE IN WHICH CONVEYANCE ERROR IS CAUSED IN THIS EMBODIMENT

LIQUID DISCHARGE APPARATUS

CROSS REFERENCE TO RELATED APPLICATION

The present application claims priority from Japanese Patent Application No. 2019-052467 filed on Mar. 20, 2019, the disclosure of which is incorporated herein by reference in its entirety.

BACKGROUND

Field of the Invention

The present disclosure relates to a liquid discharge apparatus.

Description of the Related Art

As a liquid discharge apparatus, there is known an ink-jet recording apparatus that records an image on a recording medium. When a publicly known ink-jet recording apparatus performs printing, the ink-jet recording apparatus alternatingly executes scanning (recording operation) in which ink is discharged from nozzles of a recording head (head) during movement in a main scanning direction of a carriage carrying the recording head and an operation (conveyance operation) in which the recording medium is conveyed in a conveyance direction intersecting with the main scanning direction.

The publicly known ink-jet recording apparatus executes non-discharge complement in which a non-discharge nozzle (an exemplary discharge-defective nozzle) from which no ink is discharged is detected to complement the recording for a portion that can not be recorded by the non-discharge nozzle. Specifically, after the first scan is executed, the recording medium is conveyed so that any other nozzle than the non-discharge nozzle corresponds to a void (white spot) that is not recorded by the non-discharge nozzle in the first scan. The second scan complements the recording for the void by performing recording for the void formed in the first scan by use of any other nozzle than the non-discharge nozzle.

In the above ink-jet recording apparatus, a recording area for the first scan partially overlaps with a recording area for the second scan. For the overlapping portion, only the recording for complementing the void is performed by the second scan, and the recording for remaining portions is performed by the first scan. Thus, in the above ink-jet recording apparatus, the recording area where an image is recorded by the first scan is divided into a plurality of recording areas due to the void. The recording area where an image is recorded by the second scan is disposed between two recording areas, where images are recorded by the first scan, which interpose the void in the conveyance direction. Accordingly, the recording area where the image is recorded by the first scan and the recording area where the image is recorded by the second scan are repeatedly and alternatingly arranged in the conveyance direction depending on the number of non-discharge nozzles (the number of voids) through the first scan and the second scan.

SUMMARY

Various factors may cause a conveyance error in the conveyance of the recording medium in the conveyance operation. When the conveyance error is caused in the above ink-jet recording apparatus, a positional relationship in the conveyance direction between the recording area where the image is recorded by the first scan and the recording area where the image is recorded by the second scan deviates from a desired positional relationship. The second scan may thus not appropriately complement the recording for the void formed in the first scan, and the recording for complementing the void may not be performed. This may leave the void(s), which corresponds to the number of the non-discharge nozzles, on the recording medium after completion of the second scan, which may greatly deteriorate the quality of the image to be recorded on the recording medium.

An object of the present disclosure is to provide a liquid discharge apparatus that is capable of recording an image on a recording medium even when a nozzle row includes an discharge-defective nozzle and inhibiting the deterioration in quality of an image to be recorded on the recording medium.

According to an aspect of the present disclosure, there is provided a liquid discharge apparatus, including: a conveyer configured to convey a recording medium in a conveyance direction, a head including a nozzle row in which a plurality of nozzles are arranged in the conveyance direction, a carriage carrying the head and configured to reciprocate in a scanning direction intersecting with the conveyance direction, and a controller. The controller is configured to: record an image on the recording medium by executing an recording operation, in which a liquid is discharged from the nozzles of the head based on image data during movement in the scanning direction of the carriage, and a conveyance operation in which the recording medium is conveyed by the conveyer in the conveyance direction, obtain discharge-defective nozzle information about a discharge-defective nozzle that is included in the nozzle row and of which discharge performance is lower than a predefined discharge performance, set, as a plurality of specified nozzles, the discharge-defective nozzle included in the nozzle row and all the nozzles disposed at an upstream side in the conveyance direction from the discharge-defective nozzle in the nozzle row, or the discharge-defective nozzle included in the nozzle row and all the nozzles disposed downstream of the discharge-defective nozzle in the conveyance direction in the nozzle row, based on the discharge-defective nozzle information obtained, and use another nozzle than the specified nozzles that is included in the nozzle row in the recording operation, in a case that the image is recorded.

In the above configuration, the discharge-defective nozzle belonging to the nozzle row is not used in the recording operation. Further, all the nozzles disposed at the upstream side in the conveyance direction from the discharge-defective nozzle or all the nozzles disposed at the downstream side in the conveyance direction from the discharge-defective nozzle are not used. Thus, a recording area for which an image is recorded in the recording operation is not divided into a plurality of areas in the conveyance direction. The recording area is a continuous area in the conveyance direction. Namely, in the present disclosure, a recording area for which an image is recorded by an earlier recording operation of two continuous recording operations and a recording area for which an image is recorded by a later recording operation of the two continuous recording operations are not arranged in the conveyance direction repeatedly and alternatingly. It is thus possible to inhibit the deterioration in quality of the image to be recorded on the recording medium, even when a conveyance error is caused in the conveyance of the recording medium in the conveyance operation.

DESCRIPTION OF THE EMBODIMENTS

Figure 1:
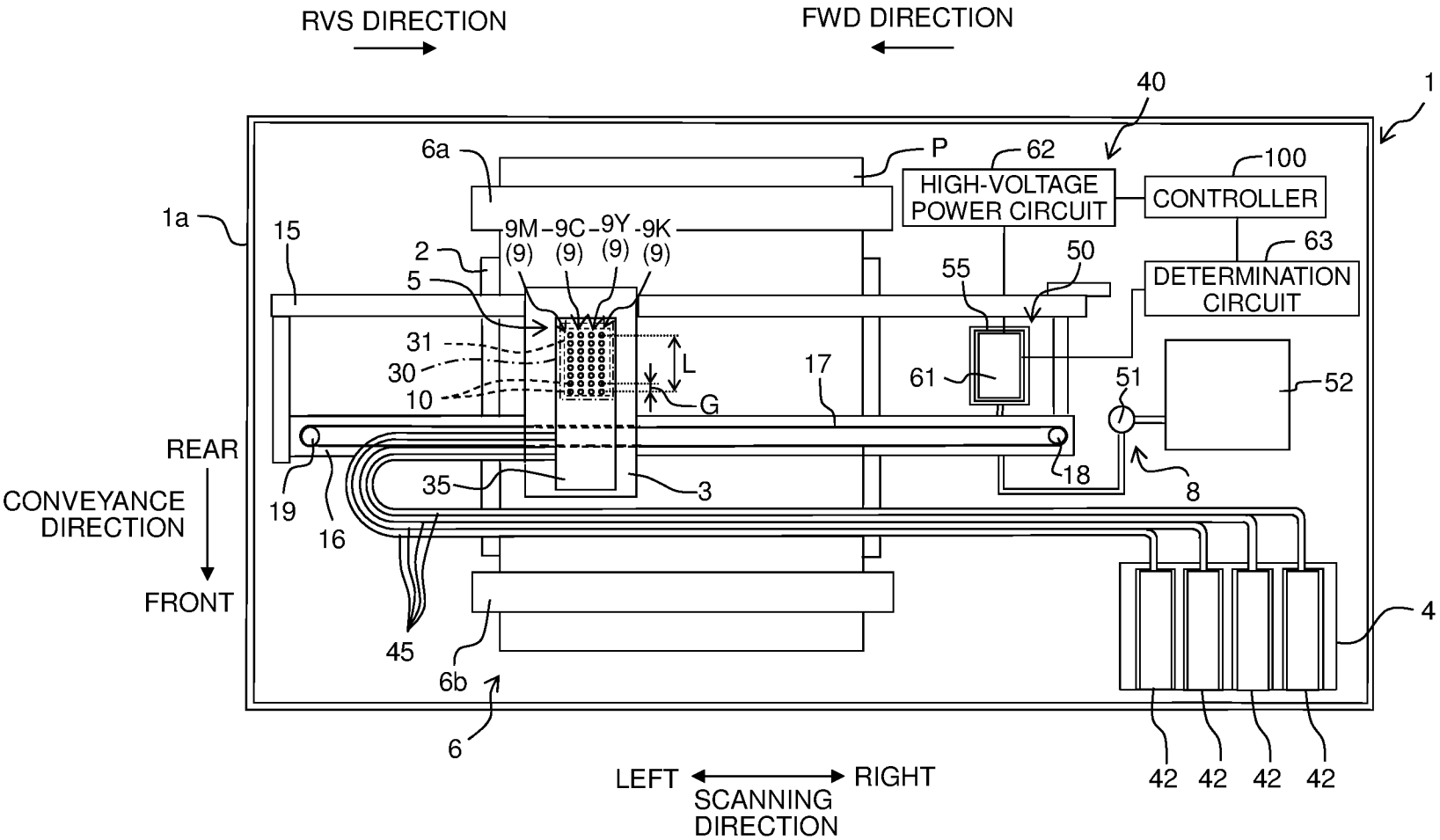
FIG. 1 schematically depicts an ink-jet printer according to this embodiment.

A schematic configuration of an ink-jet printer 1 (corresponding to a liquid discharge apparatus of the present disclosure) according to an embodiment of the present disclosure is explained. As depicted in FIG. 1, the printer 1 has a substantially rectangular parallelepiped casing 1*a*. The casing 1*a* accommodates a platen 2, a carriage 3, a holder 4, a head unit 5, a conveyer 6, a maintenance mechanism 8, a nozzle inspection apparatus 40 (corresponding to a detection apparatus of the present disclosure), and a controller 100 (corresponding to a controller of the present disclosure). In the following, the fore side (front side) of the sheet surface of FIG. 1 is defined as up (upward) of the printer 1, and the far side (the other side) of the sheet surface of FIG. 1 is defined as down (downward) of the printer 1. Further, a front-rear direction and a left-right direction in FIG. 1 are defined as a front-rear direction and a left-right direction of the printer 1. The following explanation is made based on those definitions.

A sheet P that is a recording medium is placed on an upper surface of the platen 2. Two guide rails 15 and 16 extending in parallel in the left-right direction (scanning direction) are provided above the platen 2.

The carriage 3 is attached to the two guide rails 15 and 16. The carriage 3 can reciprocate in the scanning direction along the two guide rails 15 and 16 in a region facing the platen 2. A drive belt 17 is attached to the carriage 3. The drive belt 17 is an endless belt wound around two pulleys 18 and 19. The pulley 18 is coupled to a carriage drive motor 20 (see FIG. 2). Rotating and driving the pulley 18 by the carriage drive motor 20 causes the drive belt 17 to run, which reciprocatingly moves the carriage 3 in the scanning direction. Specifically, rotating the carriage drive motor 20 normally moves the carriage 3 from a right end to a left end (FWD direction), and rotating the carriage drive motor 20 reversely moves the carriage 3 from the left end to the right end (RVS direction).

The holder 4 is disposed in front of the carriage 3. Four ink cartridges 42 are removably installed in the holder 4. The four ink cartridges 42 contain black, yellow, cyan, and magenta inks, respectively.

The head unit 5 is mounted on the carriage 3 with a gap between the head unit 5 and the platen 2. The head unit 5 reciprocates in the scanning direction together with the carriage 3. The head unit 5 includes an ink-jet head 30 (hereinafter simply referred to as a head 30) and buffer tanks 35 that are disposed on an upper surface of the head 30 and temporarily store the respective inks to be supplied to the head 30. The respective buffer tanks 35 are removably connected to first ends of four flexible ink supply tubes 45. Second ends of the four ink supply tubes 45 are connected to the holder 4. The inks in the four ink cartridges 42 installed to the holder 4 are supplied to the respective buffer tanks 35 via the four ink supply tubes 45.

Figure 3A:
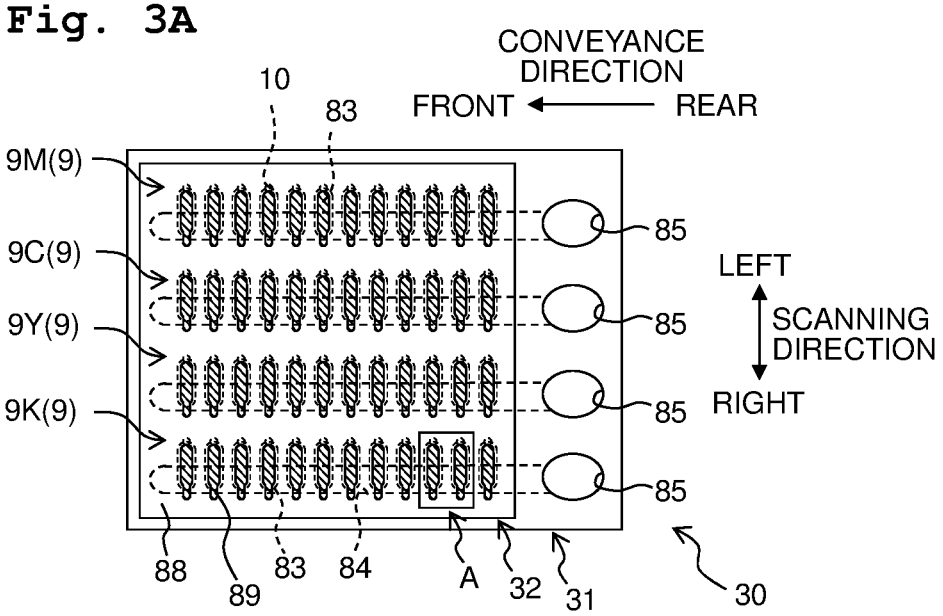
FIG. 3A is a plan view of an ink-jet head.

As depicted in FIG. 3A, the head 30 includes a channel unit 31 and an actuator 32. The channel unit 31 is formed having nozzles 10 and pressure chambers 83 that communicate with the respective nozzles 10. The channel unit 31 is made using a metal material and is connected to a ground potential. The actuator 32 is placed on an upper surface of the channel unit 31.

Figure 3B:
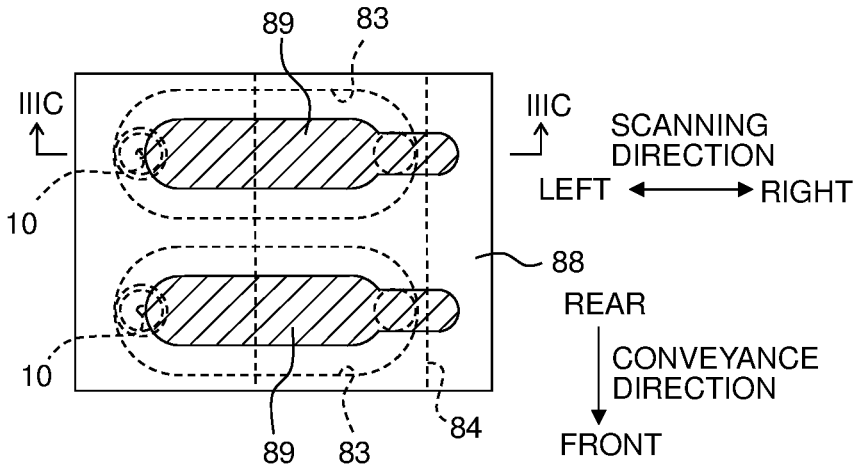
FIG. 3B is an enlarged view of a portion A in FIG. 3A.
Figure 3C:
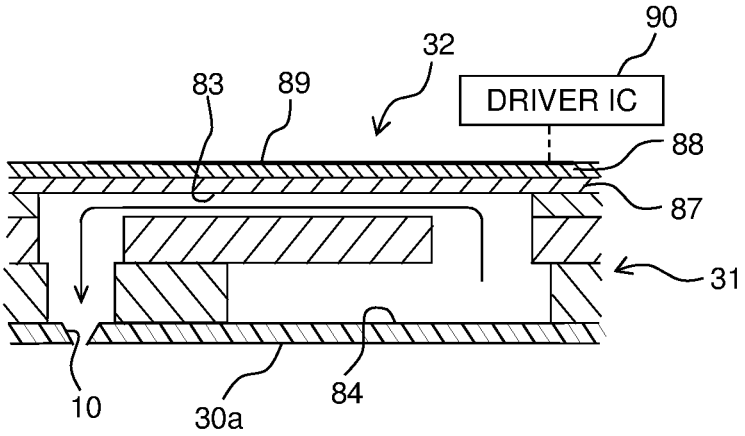
FIG. 3C is a cross-sectional view taken along a line IIIC-IIIC in FIG. 3B.

As depicted in FIG. 3C, the channel unit 31 is formed by stacking four plates. A lower surface of the channel unit 31 is a nozzle surface 30*a* where the nozzles 10 are open. The nozzle surface 30*a* is parallel to a horizontal plane. As depicted in FIG. 1, the head 30 includes four nozzle rows 9 arranged in the scanning direction. The four nozzle rows 9 include the same number of nozzles 10. In each of the nozzle rows 9, the nozzles 10 are arranged in the front-rear direction (the conveyance direction of the sheet P), which is orthogonal to the scanning direction, to have a length L at arrangement intervals G. The nozzles 10 belonging to the four nozzle rows 9 have the same positions in the conveyance direction (front-rear direction).

The four nozzle rows 9 include a black nozzle row 9K (hereinafter a nozzle row 9K) disposed at the rightmost side and from which the black ink is discharged, a yellow nozzle row 9Y (hereinafter a nozzle row 9Y) disposed at the second rightmost side and from which the yellow ink is discharged, a cyan nozzle row 9C (hereinafter a nozzle row 9C) disposed at the third rightmost side and from which the cyan ink is discharged, and a magenta nozzle row 9M (hereinafter a nozzle row 9M) disposed at the leftmost side and from which the magenta ink is discharged. One of the four nozzle rows 9 corresponds to a first nozzle row of the present disclosure, and the remaining nozzle rows 9 correspond to a second nozzle row of the present disclosure.

As depicted in FIG. 3A, the pressure chambers 83 are arranged similarly to the nozzles 10 and form four rows. Further, as depicted in FIGS. 3A and 3B, the channel unit 31 includes four manifolds 84 (corresponding to a common channel of the present disclosure) extending in the front-rear direction. The inks of four colors are supplied to the four pressure chamber rows through the four manifolds 84, respectively. The four manifolds 84 are connected to four ink supply openings 85 (corresponding to a liquid supply opening of the present disclosure) formed in the upper surface of the channel unit 31. The inks of four colors are supplied from the buffer tanks 35 to the four ink supply openings 85. In the above configuration, the channel unit 31 includes individual channels that branch off from each manifold 84 and reach the nozzles 10 via the pressure chambers 83. Further, a nozzle 10 included in each nozzle row 9 and disposed more downstream in the conveyance direction has a longer channel length from the ink supply opening 85.

As depicted in FIG. 3C, the actuator 32 includes a vibration plate 87 covering the pressure chambers 83, a piezoelectric layer 88 disposed on an upper surface of the vibration plate 87, and individual electrodes 89 corresponding to the respective pressure chambers 83. The individual electrodes 89 positioned on an upper surface of the piezoelectric layer 88 are electrically connected to a driver IC 90 driving the actuator 32.

The vibration plate 87 positioned on a lower surface of the piezoelectric layer 88 is made using a metal material. The vibration plate 87 functions as a common electrode, which faces the individual electrodes 89 with the piezoelectric layer 88 interposed therebetween. The vibration plate 87 is connected to a ground potential line of the driver IC 90. The vibration plate 87 is always kept at the ground potential.

In the above configuration, a drive signal having a predefined drive waveform is input from the driver IC 90 to a certain individual electrode 89 included in the individual electrodes 89. This deforms the volume of the piezoelectric layer 88 corresponding to the certain individual electrode 89, which applies pressure (discharge energy) to the ink in the pressure chamber 83. An ink droplet is thus discharged from the nozzle 10.

As described above, in this embodiment, a mechanism (a discharge energy applying mechanism of the present disclosure) that applies the discharge energy, by which ink is discharged from the nozzle 10, to ink is the actuator that applies the discharge energy to ink by changing the volume of the pressure chamber 83 communicating with the nozzle 10. The present disclosure, however, is not limited thereto. For example, the mechanism may be a heater that generates bubbles in the pressure chamber through heating to apply the discharge energy to ink.

Returning to FIG. 1, the conveyer 6 has two conveyance roller pairs 6*a* and 6*b*. The conveyance roller pair 6*a* is disposed upstream of the head 30 in the conveyance direction. The conveyance roller pair 6*b* is disposed downstream of the head 30 in the conveyance direction. These conveyance roller pairs 6*a* and 6*b* are driven synchronously to each other by a conveyance motor 21 (see FIG. 2), and convey the sheet P placed on the platen 2 in the conveyance direction (frontward) while nipping the sheet P.

The maintenance mechanism 8 is configured to execute a maintenance operation for maintaining and recovering the discharge performance of the head 30. The maintenance mechanism 8 includes a cap unit 50, a suction pump 51, a waste liquid tank 52, and the like.

The cap unit 50 is disposed on the right of the platen 2. When the carriage 3 is positioned at a right end of the movable area that is in a standby position, the carriage 3 faces the cap unit 50 in an up-down direction. The cap unit 50 is movable in the up-down direction by being driven by a cap drive motor 22 (see FIG. 2). The cap unit 50 includes a cap 55 that can be brought into contact with and fit to the head 30.

When the carriage 3 is in the standby position, the cap 55 faces the nozzle surface 30*a*. When the cap unit 50 moves upward in a state where the carriage 3 faces the cap unit 50, the cap 55 is fit to the head 30. This causes the cap 55 to cover all the nozzles 10 belonging to the four nozzle rows 9. When the printer 1 is on standby, all the nozzles 10 are capped with the cap 55 to inhibit the increase in viscosity of inks in the nozzles 10. The suction pump 51 is connected to the cap 55.

In the printer 1, the controller 100 can control the maintenance mechanism 8 to execute a suction purge as the maintenance operation. The suction purge is a purge in which the inks are forcibly discharged from the nozzles 10. In the suction purge, the suction pump 51 is driven in a state where the nozzles 10 are covered with the cap 55. This makes the pressure inside the cap 55 negative, forcibly discharging the inks from the nozzles 10. The inks discharged from the head 30 into the cap 55 through the suction purge are delivered to the waste liquid tank 52 connected to the suction pump 51.

The nozzle inspection apparatus 40 inspects a discharge state of the nozzles 10. The nozzle inspection apparatus 40 includes a detection electrode 61, a high-voltage power circuit 62, and a determination circuit 63.

The detection electrode 61 is a flat-plate shaped electrode. The detection electrode 61 is disposed in the cap 55. When the carriage 3 is positioned in the standby position, the detection electrode 61 faces the four nozzle rows 9 in the up-down direction at a spaced interval. When the inks are discharged from the nozzles 10 in a state where the carriage 3 is positioned in the standby position, the inks land on the detection electrode 61.

The detection electrode 61 is connected to the high-voltage power circuit 62 via a resistance (not depicted). The controller 100 can control the high-voltage power circuit 62 to make the electrical potential of the detection electrode 61 a predefined positive potential. This generates a predefined difference in electrical potential between the head 30 connected to the ground potential and the detection electrode 61.

The determination circuit 63 compares a voltage value of a voltage signal output from the detection electrode 61 with a predefined threshold value, and outputs its determination result to the controller 100. The controller 100 obtains nozzle state information (corresponding to discharge-defective nozzle information of the present disclosure) related to a discharge state of each nozzle 10, based on the determination result from the determination circuit 63.

Figure 2:
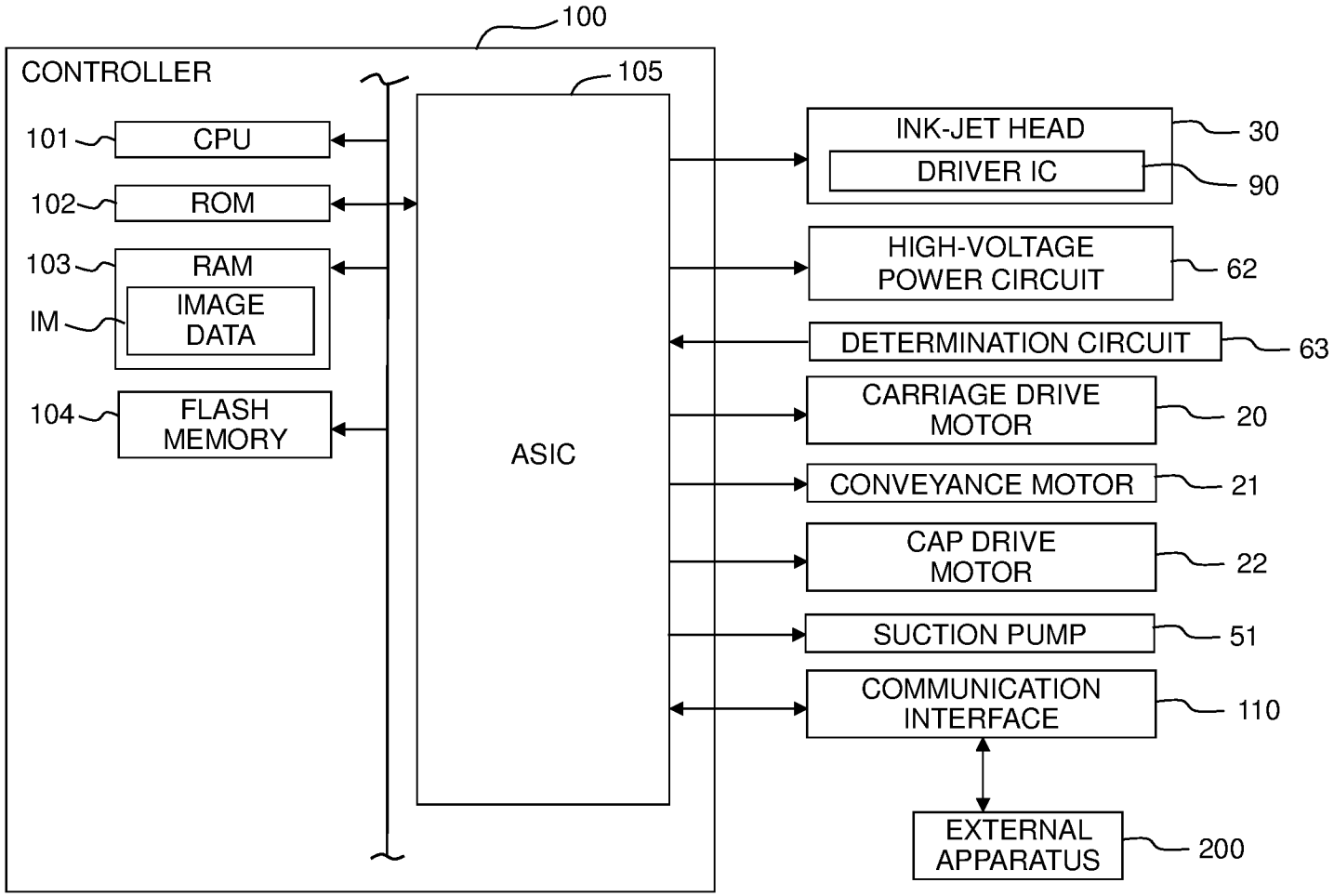
FIG. 2 is a block diagram schematically depicting an electrical configuration of the ink-jet printer.

As depicted in FIG. 2, the controller 100 includes a Central Processing Unit (CPU) 101, a Read Only Memory (ROM) 102, a Random Access Memory (RAM) 103, a flash memory 104, an Application Specific Integrated Circuit (ASIC) 105, and the like. The ROM 102 stores programs executed by the CPU 101, a variety of fixed data, and the like. The RAM 103 temporarily memorizes data and image data IM required for executing the programs. The ASIC 105 is connected to a variety of apparatuses and drive portions of the printer 1, such as the head 30, the carriage drive motor 20, the conveyance motor 21, and a communication interface 110.

In the controller 100, only the CPU 101 may execute a variety of processes, only the ASIC 105 may execute a variety of processes, or the CPU 101 may cooperate with the ASIC 105 to execute a variety of processes. In the controller 100, one CPU 101 may execute a process alone or a plurality of CPU 101 may execute a process in a shared fashion. In the controller 100, one ASIC 105 may execute a process alone or a plurality of ASIC 105 may execute a process in a shared fashion.

The controller 100 controls the CPU 101 and the ASIC 105 to execute a variety of processes in accordance with programs stored in the ROM 102. For example, when the controller 100 receives a recording instruction from an external apparatus 200 via the communication interface 110, the controller 100 executes a recording process in which an image is recorded on the sheet P. In the recording process, the controller 100 records a predefined image on the sheet P by alternatingly repeating a recording operation and a conveyance operation. In the unit recoding operation, ink is discharged from the nozzles 10 of the head 30 during the movement of the carriage 3 and the head 30 in the scanning direction. In the conveyance operation, the conveyer 6 conveys the sheet P in the conveyance direction. As described above, the printer 1 of this embodiment is a serial-type ink-jet printer.

In this embodiment, the recording operation is executed by discharging ink from the nozzles 10 both when the carriage 3 moves toward a first side in the scanning direction (in this embodiment, the RVS direction) and when the carriage 3 moves toward a second side in the scanning direction (in this embodiment, the FWD direction). As a modified example, the recording operation may be executed by discharging ink from the nozzles 10 only when the carriage 3 moves toward one of the first and second sides in the scanning direction.

In this embodiment, the recording operation uses four types (large droplet, medium droplet, small droplet, non-discharge) of ink droplet sizes (ink discharge amounts) that can be discharged from the nozzles 10 in one recording cycle. The "non-discharge" has an ink droplet size of zero, and thus no ink is discharged. Among the "large droplet", "medium droplet", and "small droplet", the "large droplet" has the largest ink droplet size and the largest ink discharge amount, the "medium droplet" has the second largest ink droplet size and the second largest ink discharge amount, and the "small droplet" has the smallest ink droplet size and eth smallest ink discharge amount. One recording cycle is a time required for the head 30 to move by a unit distance corresponding to a resolution in the scanning direction of an image to be recorded on the sheet P. In the recording operation, ink having any one of the four ink droplet sizes is discharged from the respective nozzles 10 of the head 30 during the respective recording periods based on image data IM memorized in the RAM 103.

Figure 4:
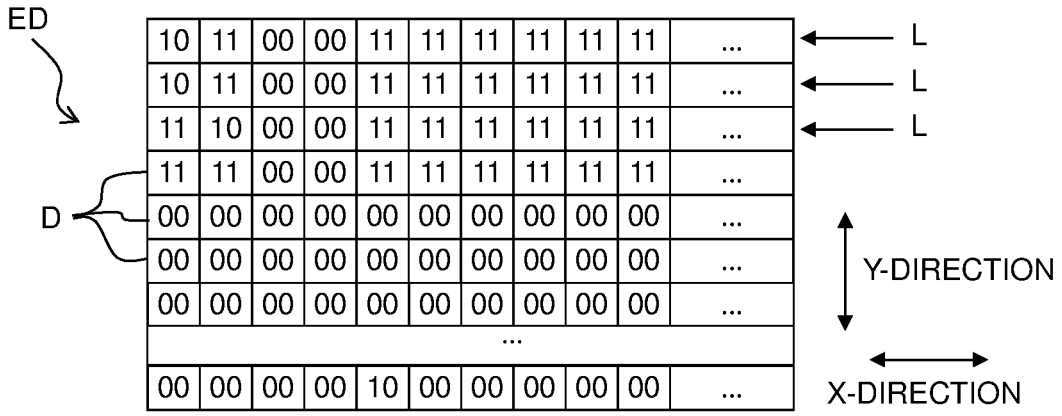
FIG. 4 depicts dot element data of image data.

The image data IM includes four dot element data ED corresponding to the four nozzle rows 9 (four color inks). As depicted in FIG. 4, each dot element data ED includes a plurality of dot elements D corresponding to a plurality of dots (including dots on which no ink lands) to be formed on the sheet P. Specifically, the dot element data ED is formed by a plurality of dot elements D arranged in an X direction and a Y direction orthogonal to each other. The X direction corresponds to the scanning direction, and the Y direction corresponds to the conveyance direction.

A droplet size (discharge amount) of ink to be discharged from the nozzle 10 when the dot corresponding to the dot element D is formed is set for each dot element D. Specifically, any of the four types (large droplet, medium droplet, small droplet, non-discharge) of ink droplet sizes that can be discharged from the nozzle 10 in one recording cycle is set for each dot element D. In the dot element data ED depicted in FIG. 4, the four types of ink droplet sizes set for the respective dot elements D are indicated by "00", "01", "10", and "11". "00" corresponds to the non-discharge, "01" corresponds to the small droplet, "10" corresponds to the medium droplet, and "11" corresponds to the large droplet.

Each dot element data ED has raster data L corresponding to a plurality of lines. The raster data L is data in which the dot elements D for the dots arranged in the scanning direction on the sheet P are arranged in accordance with a predefined order. The predefined order is an arrangement order in the scanning direction of the dots corresponding to the dot elements D. Each raster data L is allocated to any of the nozzles 10 belonging to the corresponding nozzle row 9. Namely, the raster data L is data corresponding to a dot row of one line in which dots are arranged in the scanning direction.

Figure 5:
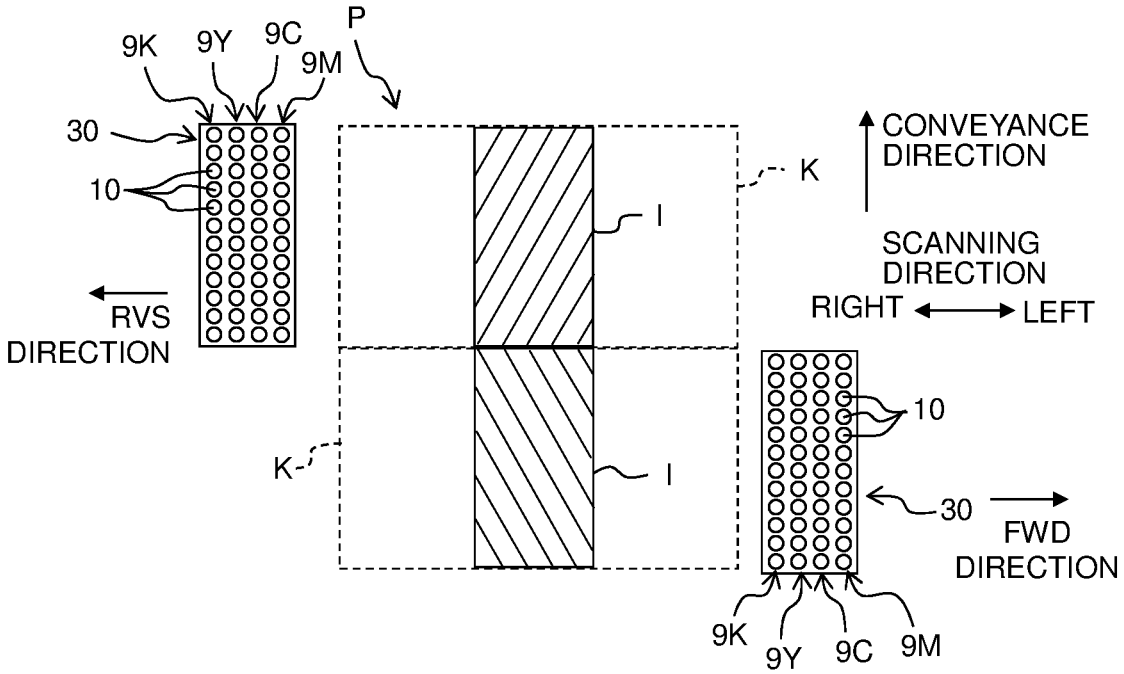
FIG. 5 illustrates scanning areas for two continuous recording operations.

In the conveyance operation executed between two continuous recording operations according to this embodiment, when all the nozzles 10 of the head 30 are normal nozzles from which inks are discharged properly or normally, the sheet P is conveyed by the length L of the nozzle row 9. Thus, as depicted in FIG. 5, in the two continuous recording operations, a scanning area K on the sheet P scanned by an earlier recording operation and a scanning area K on the sheet P scanned by a later recording operation do not overlap with each other, and these scanning areas K are arranged adjacent to each other in the conveyance direction. Thus, a recording area I where an image is recorded (ink lands) by the earlier recording operation and a recording area I where an image is recorded (ink lands) by the later recording operation do not overlap with each other. Here, the scanning area K is an area on the sheet P scanned by the nozzles 10 that are included in the nozzle row 9 and are used in the recording operation. For the purpose of convenience, FIG. 5, FIG. 7, and FIG. 9 each depict a state in which the sheet P that actually moves in the conveyance direction is fixed and the head 30 that actually does not move in the conveyance direction moves.

Ink may not be discharged properly from the nozzle 10 of the head 30 due to, for example, the increase in viscosity caused by the drying of ink in the nozzle 10. In other words, the discharge performance of the nozzle 10 may be lower than the predetermined discharge performance Examples of the predetermined discharge performance include whether or not an ink droplet of a predetermined size can be jetted, whether or not the ink droplet can be jetted at a predetermined speed, and whether or not the ink droplet can be jetted in a predetermined direction. When the nozzle 10 (hereinafter referred to as a discharge-defective nozzle 11*a*), from which ink can not be discharged properly, is used in the recording operation of the recording process, an image to be recorded on the sheet P may greatly deteriorate. Here, "the nozzle 10 is used" means that the raster data L is allocated to the nozzle 10 and the ink having an ink droplet size that is set to each dot element D of the allocated raster data L is discharged from the nozzle 10 in the recording operation. When the discharge-defective nozzle 11*a* is used in the recording operation, and when the raster data L allocated to the discharge-defective nozzle 11*a* includes the dot element D in which any of the large droplet size, the medium droplet size, and the small droplet size is set, the quality of image to be recorded on the sheet P deteriorates. More specifically, when the dot corresponding to the dot element D, in which any of the large droplet size, the medium droplet size, and the small droplet size is set, is formed, ink is not discharged properly from the nozzle 10. This causes a white streak and the like.

In view of the above, in this embodiment, the controller 100 controls the head 30, the nozzle inspection apparatus 40, and the like to inspect (detect) whether each nozzle 10 of the head 30 is the normal nozzle or the discharge-defective nozzle, and executes the nozzle inspection process for obtaining the nozzle state information that indicates the inspection result. Then, the controller 100 sets, based on the nozzle state information obtained, part of the nozzles 10 including the discharge-defective nozzle 11*a* as the specified nozzles 11. In the recording operation, the controller 100 does not use the specified nozzles 11, but uses the nozzle(s) 10 (hereinafter also referred to as a normally use nozzle(s) 12) except for the specified nozzles 11. Details of the nozzle inspection process and the setting of the specified nozzles 11 are described below.

Figure 6:
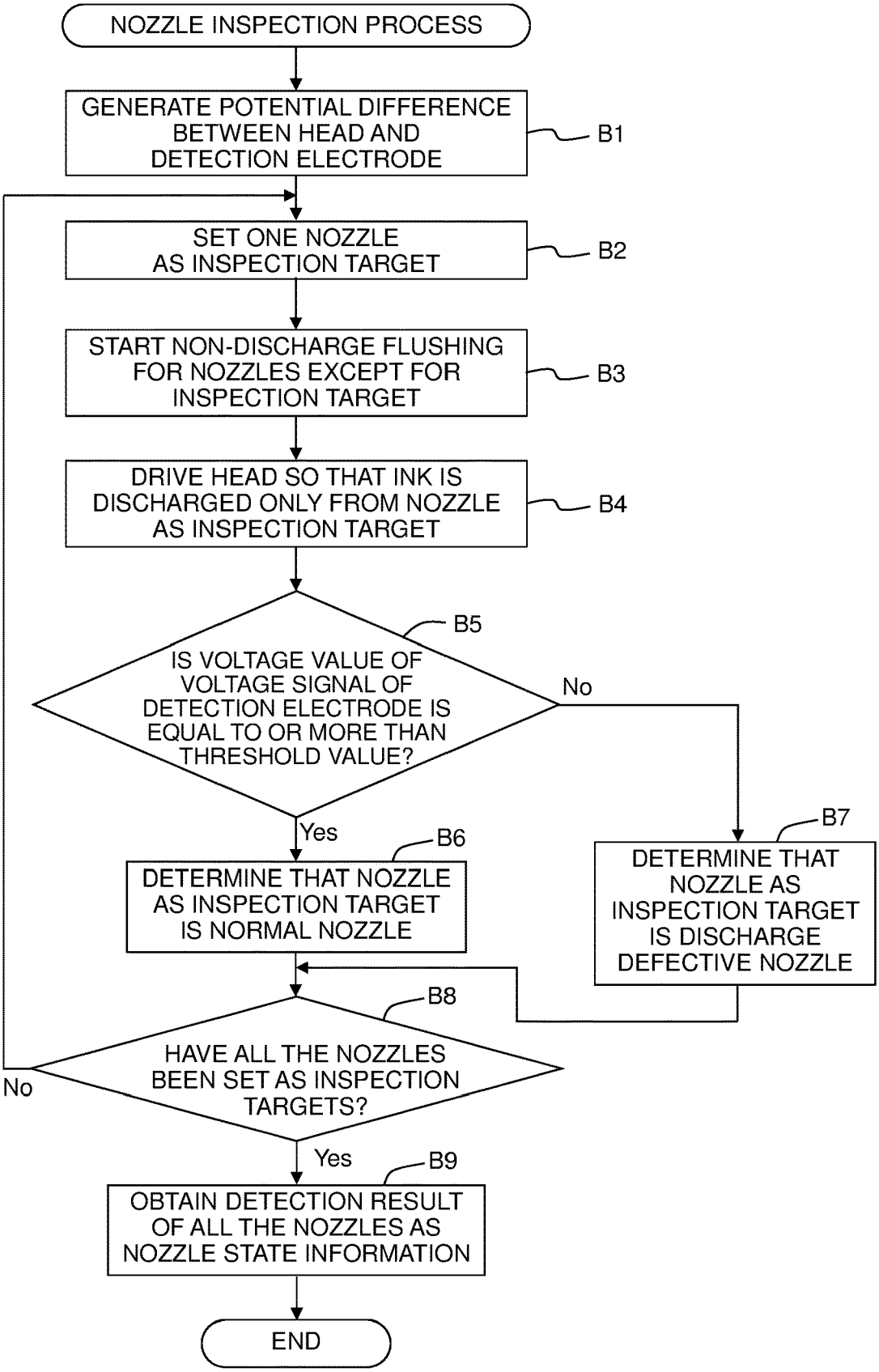
FIG. 6 is a flowchart of a nozzle inspection process.

Referring to FIG. 6, the nozzle inspection process is explained. The timing at which the nozzle inspection process is executed is not particularly limited, and is exemplified, for example, by a timing at which a recording instruction is received. The carriage 3 is in the standby position when the nozzle inspection process starts.

As indicated in FIG. 6, the controller 100 first controls the high-voltage power circuit 62 to generate a potential difference between the head 30 and the detection electrode 61 (B1). Then, the controller 100 sets one of the nozzles 10 of the head 30 as an inspection target (B2). Subsequently, the controller 100 drives the head 30 to start non-discharge flushing of which target nozzles are the nozzles 10 except for the inspection target of the head 30 (B3). The non-discharge flushing is an operation of vibrating meniscuses formed in the target nozzles without discharging ink(s) from the target nozzles. The non-discharge flushing inhibits the ink(s) in the nozzles 10 except for the inspection target from thickening due to ink drying during the nozzle inspection process. Subsequently, the controller 100 drives the head 30 so that a predefined number of ink droplets is discharged only from the nozzle 10 as the inspection target (B4).

In this situation, since the potential difference is generated between the head 30 and the detection electrode 61, the ink discharged from the nozzle 10 as the inspection target is charged. When the charged ink approaches and lands on the detection electrode 61, the electrical potential of the detection electrode 61 changes. The voltage value of the voltage signal output from the detection electrode 61 thus changes depending on the change in electrical potential of the detection electrode 61. Namely, during the drive period of the head 30, the voltage value of the voltage signal output from the detection electrode 61 is higher than a voltage value (hereinafter referred to as a reference voltage value) when the head 30 is not driven. When ink is not discharged from the nozzle 10 as the inspection target, the voltage value of the voltage signal output from the detection electrode 61 during the drive period of the head 30 is substantially the same as the reference voltage value. The determination circuit 63 thus sets a threshold value to distinguish those values. The determination circuit 63 compares the voltage value of the voltage signal that is output from the detection electrode 61 while the head 30 is driven and the threshold value, and outputs the determination result to the controller 100.

When the determination circuit 63 has determined that the voltage value of the voltage signal of the detection electrode 61 during the drive period of the head 30 is equal to or more than the threshold value (B5: YES), the controller 100 determines that the nozzle 10 as the inspection target is the normal nozzle (B6) and proceeds to a process of S8. When the determination circuit 63 has determined that the voltage value of the voltage signal of the detection electrode 61 during the drive period of the head 30 is less than the threshold (B5: NO), the controller 100 determines that the nozzle 10 as the inspection target is the discharge-defective nozzle 11*a* (non-discharge nozzle) from which ink can not be discharged (B7), and proceeds to a process of B8.

In the process of B8, the controller 100 determines whether all the nozzles 10 of the head 30 have been set as the inspection targets. When the controller 100 has determined that there is at least one nozzle 10 that is not set as the inspection target (B8: NO), the controller 100 returns to the process of B2 to set the at least one nozzle 10 that has not yet been set as the inspection target as the inspection target. When the controller 100 has determined that all the nozzles 10 have been set as the inspection targets (B8: YES), the controller 100 obtains the detection result (determination result) of all the nozzles 10 as the nozzle state information (B9), and ends the series of processes.

As described above, the controller 100 executes the nozzle inspection process to obtain the nozzle state information indicating whether the nozzles 10 of the head 30 are the normal nozzles or the discharge-defective nozzles.

The controller 100 sets the specified nozzles 11 by referring to the obtained nozzle state information. In the following, a case in which the discharge-defective nozzle 11*a* is included in the nozzle row 9K of the four nozzle rows 9 is explained as an example.

Figure 7A:
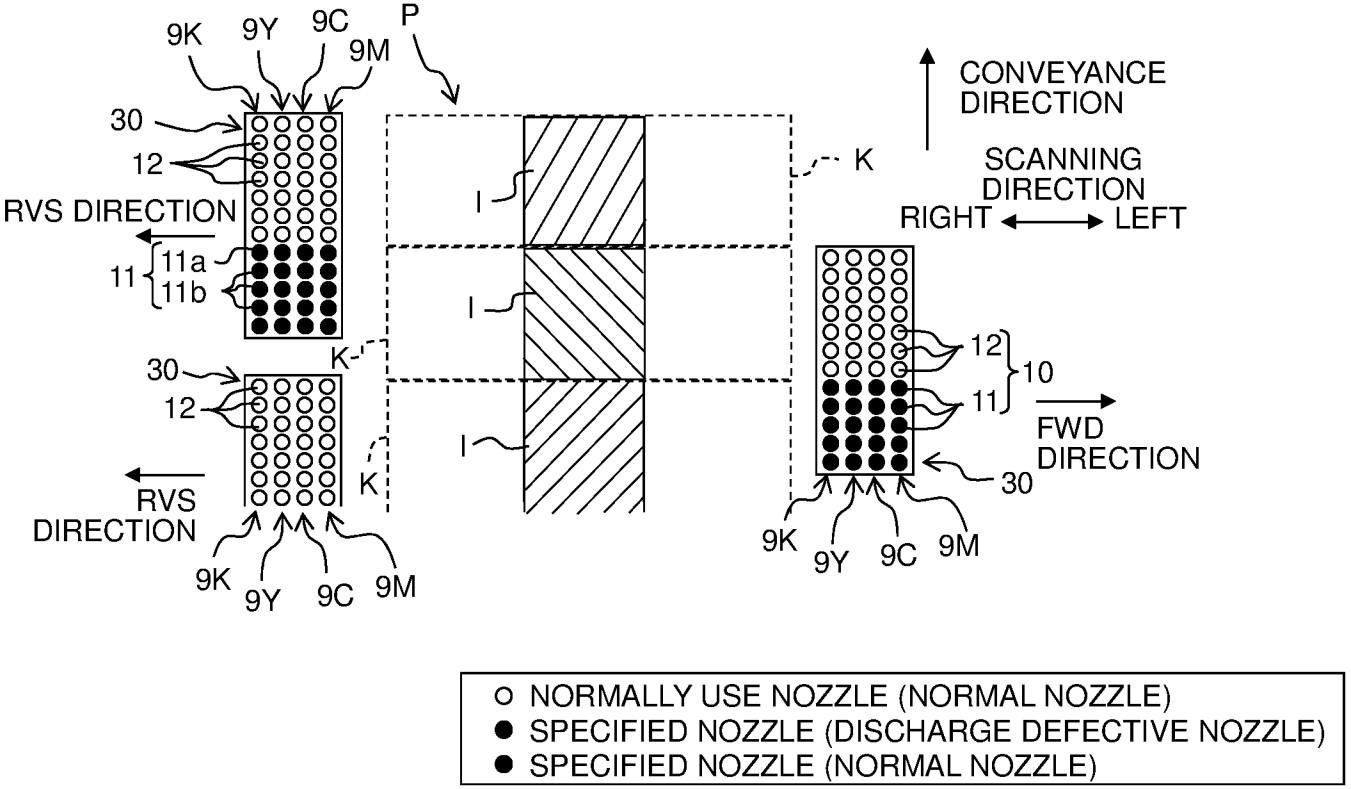
FIG. 7A illustrates nozzles to be used in the recording operation when a discharge-defective nozzle is used and when ink is required to be discharged therefrom.

As depicted in FIG. 7A, the controller 100 sets, as the specified nozzles 11, the discharge-defective nozzle 11*a* belonging to the nozzle row 9K and all the nozzles 11*b* belonging to the nozzle row 9K and disposed at any one of the upstream side and the downstream side in the conveyance direction from the discharge-defective nozzle 11*a*. Specifically, the controller 100 sets the specified nozzles 11 in the nozzle row 9K so that the number of the normally use nozzles 12 that can be used in the recording operation is maximized. For example, when the discharge-defective nozzle 11*a* in the nozzle row 9K is disposed at the upstream side in the conveyance direction from a center position in the conveyance direction of the nozzle row 9K, the controller 100 sets, as the specified nozzles 11, the discharge-defective nozzle 11*a* and all the nozzles 11*b* disposed at the upstream side in the conveyance direction from the discharge-defective nozzle 11*a*. In FIGS. 7A and 7B, FIG. 9C, and FIG. 10A, the normally use nozzles 12 are illustrated in white. The discharge-defective nozzles 11*a* included in the specified nozzles 11 are illustrated in black, and the nozzles 11*b* that are included in the specified nozzles 11 and are the normal nozzles are illustrated in gray.

The nozzle row 9K may include a plurality of discharge-defective nozzles 11*a*. In this case, the controller 100 sets, as the specified nozzles 11, the discharge-defective nozzles 11*a* belonging to the nozzle row 9K and all the nozzles 11*b* belonging to the nozzle row 9K and disposed at any one of the upstream side and the downstream side in the conveyance direction from the discharge-defective nozzles 11*a*. In this case also, the controller 100 sets the specified nozzles 11 in the nozzle row 9K so that the number of the normally use nozzles 12 that can be used in the recording operation is maximized.

Regarding the three nozzle rows 9Y, 9C, and 9M except for the nozzle row 9K, as depicted in FIG. 7A, the nozzles 10 disposed at the same positions in the conveyance direction as the specified nozzles 11 in the nozzle row 9K are set as the specified nozzles 11.

The discharge-defective nozzles 11*a* may be included in the nozzle rows 9. In this case, in each of the nozzle rows 9 including the discharge-defective nozzle 11*a*, the discharge-defective nozzle 11*a* and all the nozzles 11*b* disposed at any one of the upstream side and the downstream side in the conveyance direction from the discharge-defective nozzle 11*a* are set as the specified nozzles 11. Further, in each of the four nozzle rows 9, the nozzles 10 disposed at the same positions in the conveyance direction as the specified nozzles 11 set in any of the four nozzle rows 9 are set as the specified nozzles 11. In this case also, the specified nozzles 11 are set in the respective nozzle rows 9 so that the number of the normally use nozzles 12 that can be used in the recording operation is maximized.

When the specified nozzles 11 are set as described above, the normally use nozzles 12 except for the specified nozzles 11 are arranged continuously in the conveyance direction in the respective nozzle rows 9. In each recording operation in the recording process, only the normally use nozzles 12 except for the specified nozzles 11 are used. This allows the scanning area K on the sheet P scanned by the normally use nozzles 12 in each recording operation to be a continuous area in the conveyance direction, as depicted in FIG. 7A.

In the conveyance operation executed between two continuous recording operations, the paper P is conveyed by an amount corresponding to a length in the conveyance direction of the normally use nozzles 12 that are continuously arranged in the conveyance direction. Thus, the scanning area K of the earlier recording operation and the scanning area K of the later recording operation do not overlap with each other, and the scanning areas K are arranged adjacent to each other in the conveyance direction.

As described above, in this embodiment, only the normally use nozzles 12 are used without using the specified nozzles 11 in the recording operations in the recording process. Thus, even when the head 30 includes the discharge-defective nozzle(s) 11*a*, an image can be recorded on the sheet P. Namely, an image can be recorded on the sheet P without restoring all the nozzles 10 of the head 30 to normal nozzles by the suction purge or the like before the start of the recording process. This shortens the time after the recording instruction is received until the recording process starts.

When the specified nozzles 11 are not used in the recording operation, the length in the conveyance direction of the scanning area K is shorter than a case in which all the nozzles 10 in the nozzle row 9 are used in the recording operation (see FIG. 5). Thus, when the specified nozzles 11 are not used in the recording operation, the length in the conveyance direction of the scanning area K is shortened to increase the number of execution times of the recording operation. This lengthens the time for the recording process.

Even when the discharge-defective nozzle 11*a* is used in the recording operation, ink may not be required to be discharged from the discharge-defective nozzle 11*a*. In this case, the quality of an image to be recorded on the sheet P does not deteriorate. Namely, when the ink droplet size set for all the dot elements D of the raster data L allocated for the discharge-defective nozzle 11*a* is the non-discharge, no problem is caused even when the discharge-defective nozzle 11*a* is used.

In view of the above, in this embodiment, when the discharge-defective nozzle 11*a* is used in each of the recording operations, the controller 100 determines based on the image data IM whether ink is required to be discharged from the discharge-defective nozzle 11*a*. Specifically, when the raster data L allocated for the discharge-defective nozzle 11*a* includes the dot element D in which any of the large droplet size, the medium droplet size, and the small droplet size is set, the controller 100 determines that ink is required to be discharged from the discharge-defective nozzle 11*a*. When the ink droplet size set to all the dot elements D of the raster data L allocated for the discharge-defective nozzle 11*a* is the non-discharge, the controller 100 determines that ink is not required to be discharged from the discharge-defective nozzle 11*a*.

Figure 7B:
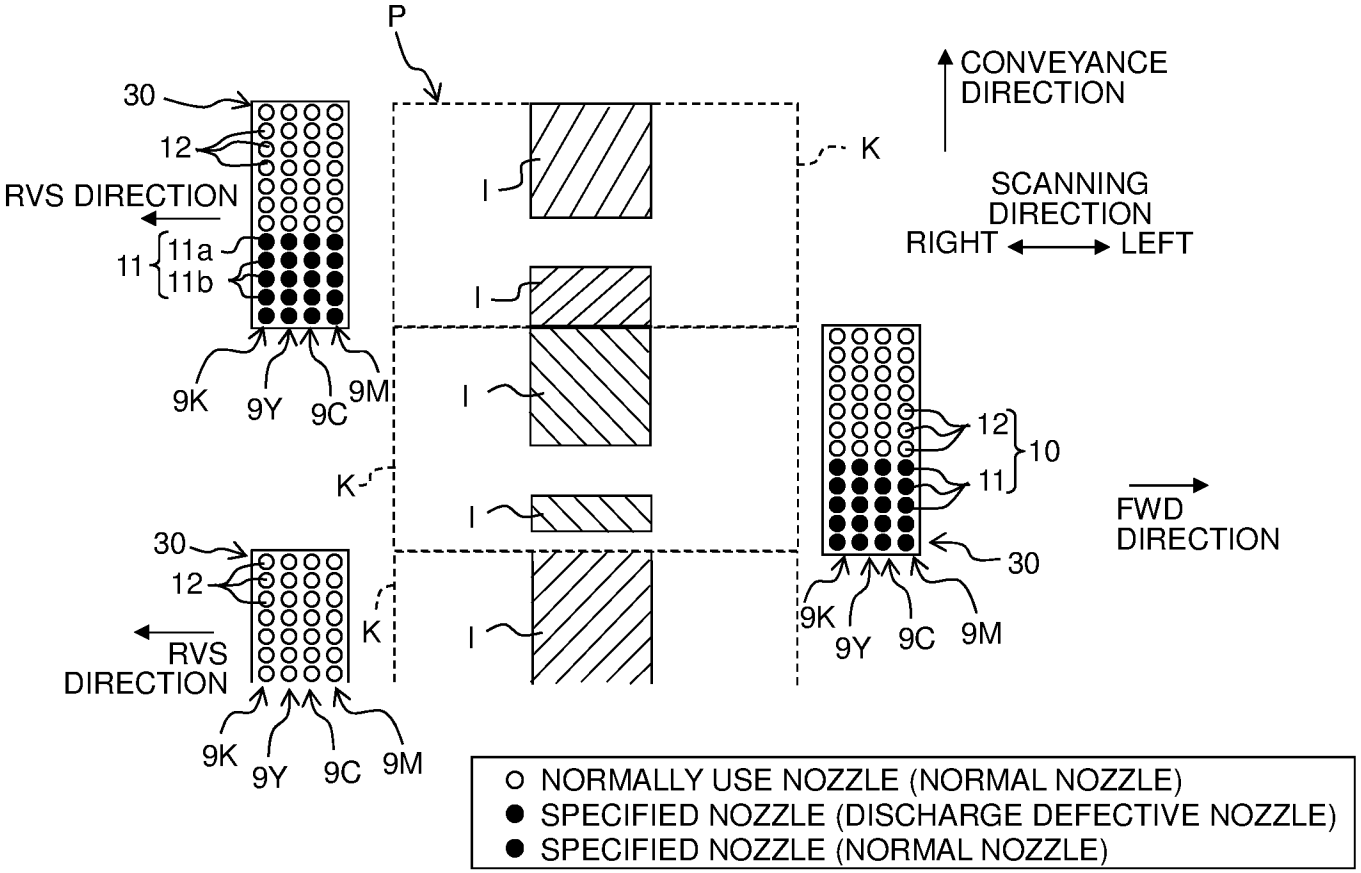
FIG. 7B illustrates nozzles to be used in the recording operation when the discharge-defective nozzle is used and when ink is not required to be discharged therefrom.

The controller 100 uses the normally use nozzles 12 except for the specified nozzles 11 in the recording operation that has been determined that ink is required to be discharged from the discharge-defective nozzle 11*a*, as depicted in FIG. 7A. The controller 100 uses not only the normally use nozzles 12 but also the specified nozzles 11 in the recording operation that has been determined that ink is not required to be discharged from the discharge-defective nozzle 11*a*, as depicted in FIG. 7B. Namely, the controller 100 uses all the nozzles 10 of the respective nozzle rows 9.

As described above, in each recording operation, whether to use the specified nozzles 11 changes depending on whether ink is required to be discharged from the discharge-defective nozzle 11*a*. This reduces the number of execution times of the recording operation compared to a case in which no specified nozzles 11 are used in all the recording operations, thus shortening the time for the recording process.

When the head 30 includes a plurality of discharge-defective nozzles 11*a*, and when the controller 100 has determined that ink is not required to be discharged from all the discharge-defective nozzles 11*a* in the recording operation, not only the normally use nozzles 12 but also the specified nozzles 11*a* are used in the recording operation. When the head 30 includes a plurality of discharge-defective nozzles 11*a*, and when the controller 100 has determined that ink is required to be discharged from at least any one of the discharge-defective nozzles 11*a* in the recording operation, only the normally use nozzles 12 are used in the recording operation.

As a modified example, when the discharge-defective nozzles 11*a* include the discharge-defective nozzle(s) 11*a* from which ink is required to be discharged in the recording operation and the discharge-defective nozzle(s) 11*a* from which ink is not required to be discharged in the recording operation, part of the specified nozzles 11 may be used in addition to the normally use nozzles 12 in the recording operation. Specifically, when the specified nozzles 11 are set by exceptionally regarding the discharge-defective nozzle(s) 11*a* from which ink is not required to be discharged in the recording operation as the normal nozzle(s), the nozzle(s) 10 that is/are regarded as the normally use nozzle(s) 12 at the setting of the specified nozzles 11 may be used in the recording operation.

Figure 8A:
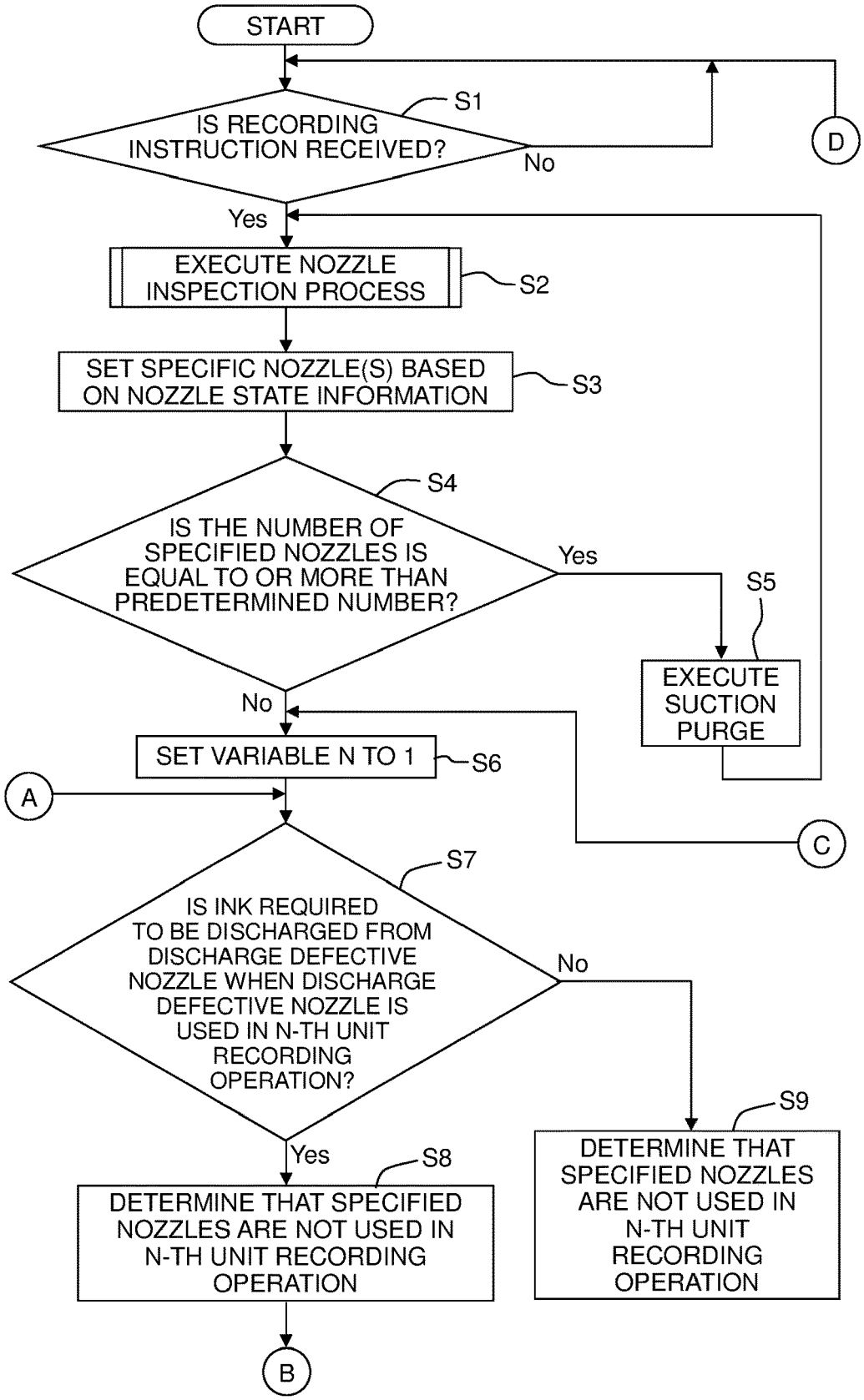
FIGS. 8A and 8B depict flowcharts indicating processing operations related to a recording process of the ink-jet printer.
Figure 8B:
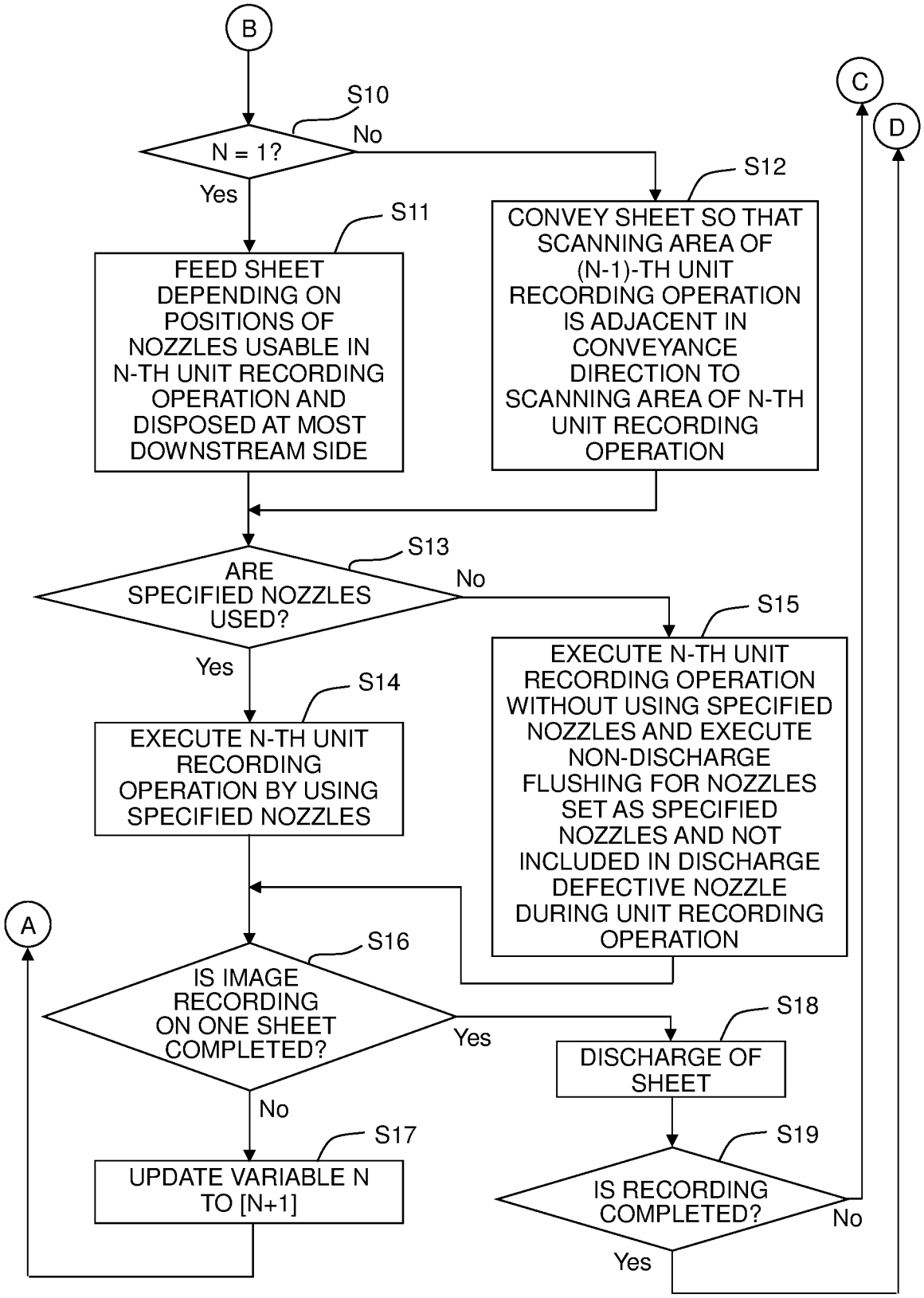

Referring to FIGS. 8A and 8B, a series of processing operations related to the recording process is explained.

When receiving a recording instruction from the external apparatus 200 (S1: YES), the controller 100 executes the nozzle inspection process described above (S2). The controller 100 sets the specific nozzle(s) 11 for each nozzle row 9 based on the nozzle state information obtained in the nozzle inspection process of S2 (S3).

As described above, when the number of the specified nozzles 11 is larger, the number of execution times of the recording operation increases. This lengthens the time for the recording process. Thus, when the number of the specified nozzles 11 of the head 30 is equal to or more than a predefined number, the suction purge may be executed before the recording process and the recording process may be executed after all the nozzles 10 of the head 30 return to the normal nozzles. This is highly likely to shorten the time after the recording instruction is received until the recording process is completed, compared to a case in which the recording process is executed without using the specified nozzles 11.

The controller 100 thus determines whether the number of the specified nozzles 11 of the head 30 is equal to or more than the predetermined number (S4). When the controller 100 has determined that the number of the specified nozzles 11 is equal to or more than the predetermined number (S4: YES), the controller 100 controls the maintenance mechanism 8 to execute the suction purge (S5). This suction purge restores the discharge performance of each nozzle 10 of the head 30. After completing the process of S5, the controller 100 returns to the process of S2. As a modified example, the controller 100 may determine that the suction purge restored all the nozzles 10 to the normal nozzles, and may start the recording process without returning to the process of S2. In this case, all the nozzles 10 are used in each recording operation of the recording process.

When the controller 100 has determined in the process of S4 that the number of the specified nozzles 11 is less than the predefined number (S4: NO), the controller 100 sets a variable N to 1 (S6). Next, the controller 100 determines, based on the image data IM, whether ink is required to be discharged from the discharge-defective nozzle 11*a* when the discharge-defective nozzle 11*a* is used in the N-th recording operation (S7). When the controller 100 has determined that ink is required to be discharged from the discharge-defective nozzle 11*a* (S7: YES), the controller 100 determines that the specified nozzles 11 are not used in the N-th recording operation (S8). After completing the process of S8, the controller 100 proceeds to a process of S10. When the controller 100 has determined that ink is not required to be discharged from the discharge-defective nozzle 11*a* (S7: NO), the controller 100 determines that the specified nozzles 11 are used in the N-th recording operation (S9). After completing the process of S9, the controller 100 proceeds to the process of S10.

In the process of S10, the controller 100 determines whether the variable N is 1. When the controller 100 has determined that the variable N is 1 (S10: YES), the controller 100 feeds the sheet P (S11) by a feed unit (not depicted) so that the nozzles 10 belonging to the nozzle row 9, included in the nozzles 10 usable in the N-th recording operation (the first recording operation), and disposed at the most downstream side in the conveyance direction face a recording position at the most downstream side in the conveyance direction of the sheet P. When the controller 100 has determined that the variable N is not 1 (S10: NO), the controller 100 executes the conveyance operation (S12). In the conveyance operation, the conveyer 6 conveys the sheet P so that the scanning area K of the (N−1)-th recording operation is adjacent in the conveyance direction to the scanning area K of the N-th recording operation without overlapping with each other.

After the process of S11 or S12, when the controller 100 has determined in the process of S9 that the specified nozzles 11 are used in the N-th recording operation (S13: YES), the controller 100 executes the N-th recording operation using not only the normally use nozzles 12 but also the specified nozzles 11 (S14).

When the controller 100 has determined in the process of S8 that the specified nozzles 11 are not used in the N-th recording operation (S13: NO), the controller 100 executes the N-th recording operation using the normally use nozzles 12 except for the specified nozzles 11 (S15). In the process of S15, the controller 100 sets the nozzles 11*b* that are included in the nozzles 10 set as the specified nozzles 11 and that are not the discharge-defective nozzle 11*a*, as the target nozzles. Then, the controller 100 controls the head 30 to execute the non-discharge flushing for the target nozzles. This non-discharge flushing inhibits ink in the target nozzles from thickening during the recording operation, thus inhibiting the deterioration in discharge characteristics of the target nozzles. As a modified example, not only the nozzles 11*b* but also the discharge-defective nozzle 11*a* may be set as the target nozzles for the non-discharge flushing. This inhibits the discharge characteristics of the discharge-defective nozzle 11*a* from further deteriorating.

The viscosity of the ink in the nozzle 10 may vary depending on the position where the nozzle 10 is formed. For example, the nozzles 10 in each nozzle row 9 have different channel lengths from the corresponding ink supply opening 85 to the respective nozzles 10. Further, the viscosity of ink typically increases due to the volatilization of a solvent and the like, as ink stays in the channel of the head 30 for a longer time. Here, fresh ink is not likely to be supplied from the ink supply opening 85 to the nozzle 10 having a longer channel length from the ink supply opening 85. This reduces the opportunities for replacing old ink by fresh ink, and thus the ink is likely to stay and accumulate in the longer channel. The nozzle 10 having a longer channel length from the ink supply opening 85 is thus more likely to deteriorate in discharge characteristics. The controller 100 thus increases the number of execution times of the non-discharge flushing for the nozzle 10 set as the target nozzle and having a longer channel length from the ink supply opening 85 in the recording operation. More specifically, the controller 100 shortens execution intervals of the non-discharge flushing for the nozzle 10 set as the target nozzle and having a longer channel length from the ink supply opening 85. This reliably inhibits the deterioration in the discharge characteristics of the target nozzle.

After the process of S14 or S15, the controller 100 determines whether image recording on one sheet P is completed (S16). When the controller 100 has determined that image recording on the one sheet P is not completed (S16: NO), the controller 100 updates the variable N to [N+1] (S17) and returns to the process of S7. When the controller 100 has determined that image recording on the one sheet P is completed (S16: YES), the controller 100 controls the conveyer 6 to discharge the sheet P for which image recording has been performed on an unillustrated discharge tray (S18). Then, the controller 100 determines whether image recording based on the recording instruction is completed (S19). When the controller 100 has determined that the image recording is completed (S19: YES), the controller returns to the process of S1. When the controller 100 has determined that the image recording is not completed (S19: NO), the controller 100 returns to the process of S6 to execute image recording on the next sheet P.

As described above, in this embodiment, an image can be recorded on the sheet P even when the head 30 includes the discharge-defective nozzle(s) 11*a* by using only the normally use nozzles 12 without using the specified nozzles 11 in the recording operation of the recording process.

The method of recording an image on the sheet P when the head 30 includes the discharge-defective nozzle(s) 11*a* may be any other method without being limited to the method of this embodiment. For example, there is a method of complementing a portion that can not be recorded by the discharge-defective nozzle 11*a* in the earlier recording operation with recording in the later recording operation (hereinafter referred to as a comparative example). This comparative example is explained below in detail. In the following, for the purpose of convenience, a case in which a nozzle 10 included in the nozzles 10 belonging to the nozzle row 9 and not disposed at both ends in the conveyance direction is the discharge-defective nozzle 11*a* is explained as an example.

Figure 9A:
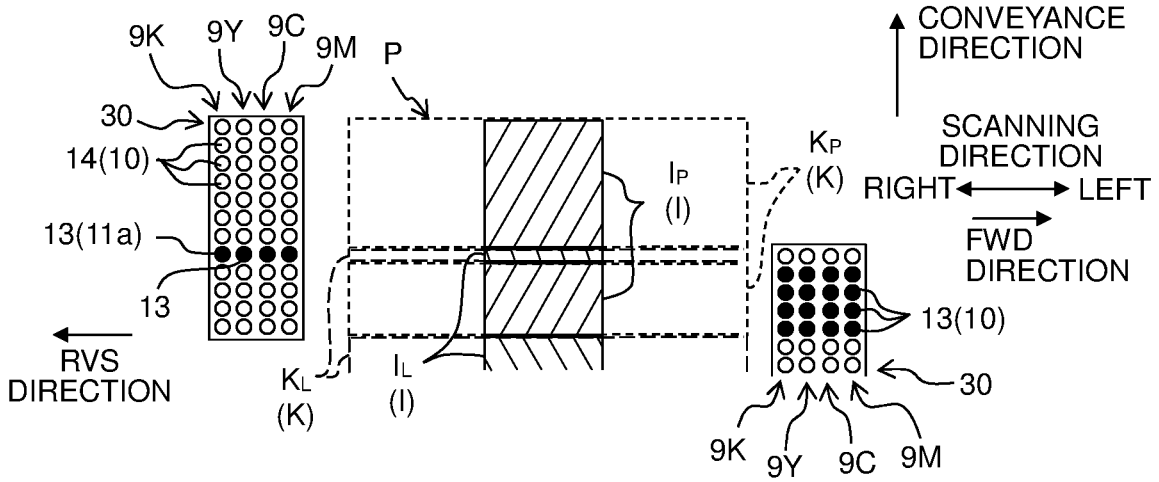
FIG. 9A illustrates scanning areas for two continuous recording operations when no conveyance error is generated, according to a comparative example.

As depicted in FIG. 9A, in the comparative example, the discharge-defective nozzle 11*a* and the nozzles 10 having the same position in the conveyance direction as the discharge-defective nozzle 11*a* are set as non-use nozzles 13, and any other nozzles 10 than the non-use nozzles 13 are set as use nozzles 14 in the earlier recording operation of two continuous recording operations. Only the use nozzles 14 are used in the earlier recording operation (i.e., the non-use nozzles 13 are not used). Thus, in the earlier recording operation, the use nozzles 14 are arranged on both the upstream side and the downstream side in the conveyance direction with respect to the non-use nozzles 13 (discharge-defective nozzle 11*a*). The scanning area K scanned by the use nozzles 14 (hereinafter referred to as scanning area $K_p$) in the earlier recording operation is divided into a plurality of areas in the conveyance direction depending on the number of discharge-defective nozzles 11*a*.

Then, the sheet P is conveyed so that the normal nozzles of each nozzle row 9 correspond to a dot row (hereinafter referred to as an unrecorded dot row) that is not recorded by the non-use nozzles 13 in the earlier recording operation. In the later recording operation, recording is performed for the unrecorded dot row formed in the earlier recording operation by use of the normal nozzles of each nozzle 9. Here, in the later recording operation, the nozzles 10 corresponding to the dot row recorded in the earlier recording operation are set as the non-use nozzles 13 and they are not used. Thus, also in the later recording operation, the use nozzles 14 are arranged on both the upstream side and the downstream side in the conveyance direction with respect to the non-use nozzles 13. Thus, the scanning area K scanned by the use nozzles 14 (hereinafter referred to as scanning area $K_L$) in the later recording operation is also divided into a plurality of areas in the conveyance direction.

Figure 9B:
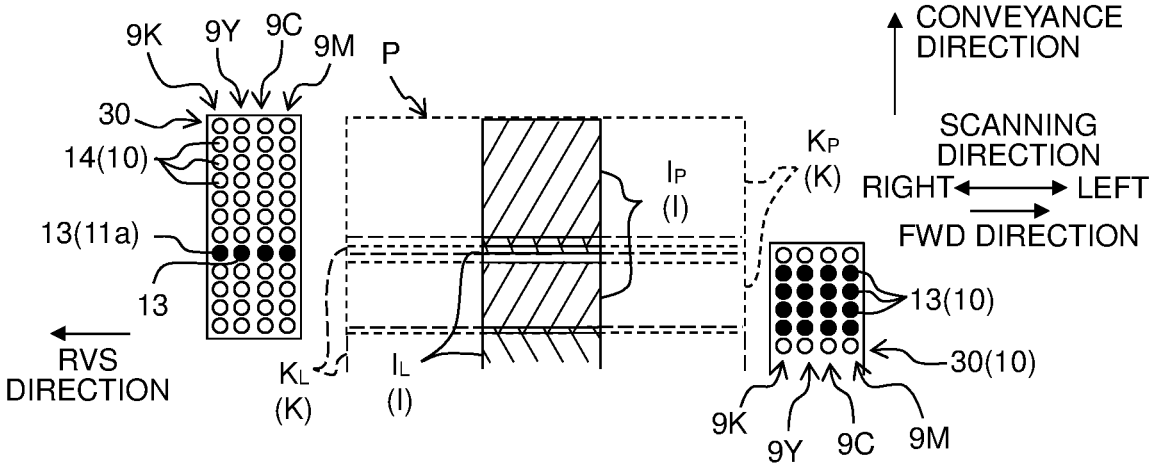
FIG. 9B illustrates scanning areas for two continuous recording operations when the conveyance error is generated, according to another comparative example.

Accordingly, in the two continuous recording operations, the scanning area $K_p$ and the scanning area $K_L$ are repeatedly and alternatingly arranged in the conveyance direction depending on the number of discharge-defective nozzles 11*a*. Thus, a recording area I of the earlier recording operation (hereinafter referred to as a recording area $I_p$) and a recording area I of the later recording operation (hereinafter referred to as a recording area $I_L$) are repeatedly and alternatingly arranged in the conveyance direction. In FIGS. 9A and 9B, the use nozzles 14 are illustrated in white, the discharge-defective nozzles 11*a* included in the non-use nozzles 13 are illustrated in black, and the normal nozzles included in the non-use nozzles 13 are illustrated in gray.

As described above, in the comparative example, the portion that can not be recorded by the discharge-defective nozzle 11*a* in the earlier recording operation is complemented by the recording in the later recording operation. This makes it possible to record an image on the sheet P even when the head 30 includes the discharge-defective nozzle(s) 11*a*.

Various factors may cause a conveyance error in the conveyance of the sheet P in the conveyance operation. When such a conveyance error is caused in the comparative example, a positional relationship in the conveyance direction between the scanning area $K_P$ and the scanning area $K_L$ deviates from a desired positional relationship. This may lead to a case as depicted in FIG. 9B. Namely, the recording for the unrecorded dot row in the earlier recording operation can not be appropriately complemented in the later recording operation, and recording is not performed for the unrecorded dot row in the later recording operation. As a result, after completion of the later recording operation, a streak-like density unevenness (white streak and the like) extending in the scanning direction is left on the sheet P depending on the number of discharge-defective nozzles 11*a*. Namely, the density unevenness is caused at each joint or seam portion between the recording area $I_P$ of the earlier recording operation and the recording area $I_L$ of the later recording operation. This may greatly deteriorate the quality of the image to be recorded on the sheet P.

Figure 9C:
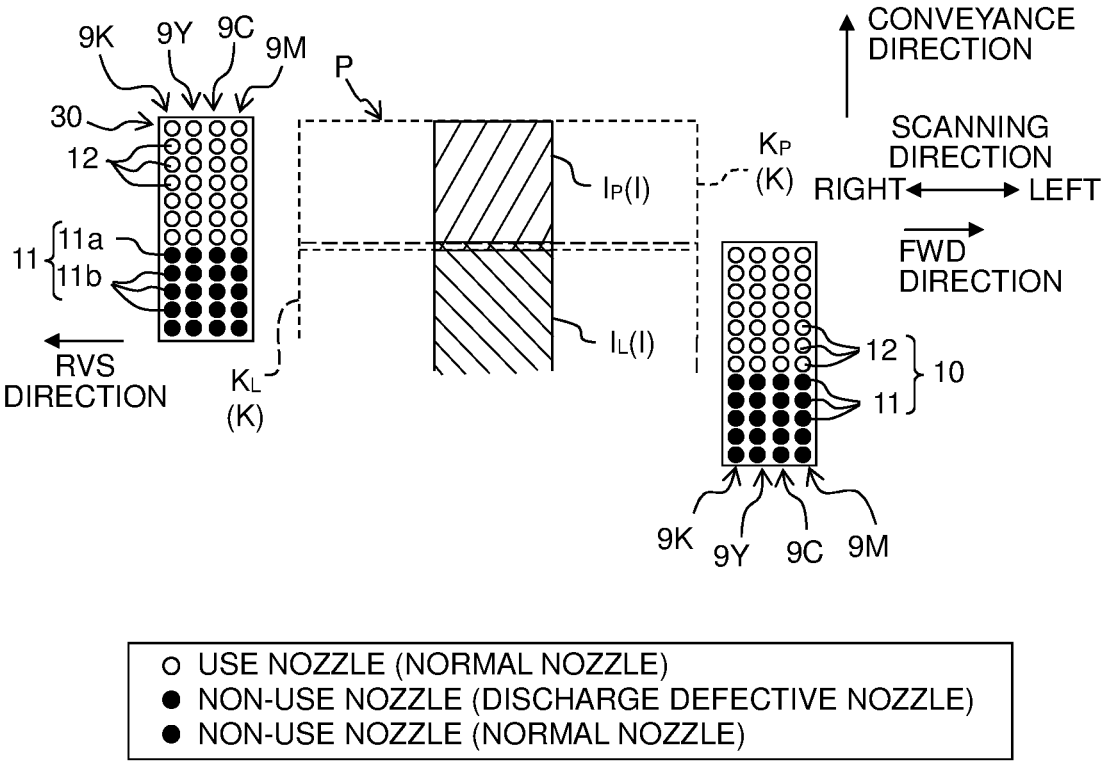
FIG. 9C illustrates scanning areas for two continuous recording operations when the conveyance error is generated, according to this embodiment.

In this embodiment, as depicted in FIG. 9C, the scanning areas K of the recording operations are not divided into a plurality of areas in the conveyance direction, namely, the scanning areas K continue in the conveyance direction. Namely, in this embodiment, the scanning area $K_P$ of the earlier recording operation and the scanning area $K_L$ of the later recording operation in two continuous recording operations are not repeatedly and alternately arranged in the conveyance direction. The recording area $I_P$ of the earlier recording operation and the recording area $I_L$ of the later recording operation are thus not repeatedly and alternately arranged in the conveyance direction. Namely, in this embodiment, the number of joints or seam portions between the recording area $I_P$ of the earlier recording operation and the recording area $I_L$ of the later recording operation is one, and the number of joints is smaller than that of the comparative example. Accordingly, in this embodiment, when the conveyance error is caused in the conveyance of the recording sheet P in the conveyance operation, and when the positional relationship in the conveyance direction between the scanning area $K_p$ and the scanning area $K_L$ deviates from the desired positional relationship, the quality of the image to be recorded on the sheet P is less likely to deteriorate compared to the comparative example.

Figure 10A:
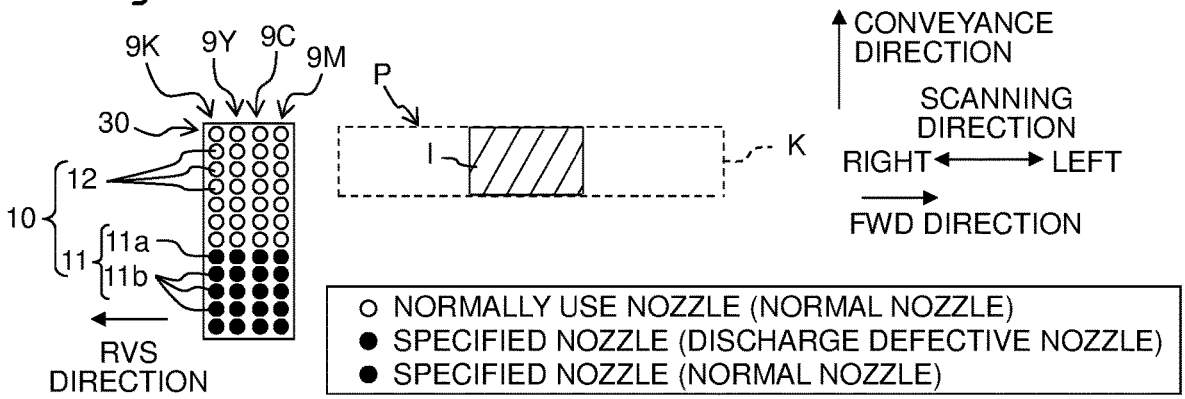
FIG. 10A illustrates a method of setting specified nozzles according to a modified example, FIGS. 10B and 10C each illustrate a case in which the discharge-defective nozzle and all the nozzles disposed at a downstream side in the conveyance direction from the discharge-defective nozzle are set as the specified nozzles, and FIGS. 10D and 10E each illustrate a case in which the discharge-defective nozzle and all the nozzles disposed at an upstream side in the conveyance direction from the discharge-defective nozzle are set as the specified nozzles.

The embodiment of the present disclosure is explained above. The present disclosure, however, is not limited to the above embodiment. Various changes or modifications may be made without departing from the claims. For example, when the specified nozzles 11 are set in the above embodiment, the discharge-defective nozzle 11*a* and all the nozzles 11*b* disposed at any one of the upstream side and the downstream side in the conveyance direction from the discharge-defective nozzle 11*a* are set as the specified nozzles 11 so that the number of normally use nozzles 12 that can be used in the recording operation is maximized. The present disclosure, however, is not limited thereto. For example, as depicted in FIG. 10A, the discharge-defective nozzle 11*a* and all the nozzles 11*b* disposed at the upstream side in the conveyance direction from the discharge-defective nozzle 11*a* may be uniformly set as the specified nozzles 11. Prior to explaining the effect, assumptions thereof are explained below.

When ink lands on the sheet P, the ink permeates into the sheet P and the sheet P swells. Thus, in two continuous recording operations, when ink lands on a certain area of the sheet P in the earlier recording operation, and when ink is discharged to an adjacent area that is adjacent to the certain area at the upstream side in the conveyance direction in the later recording operation, a distance between the adjacent area and the head 30 (hereinafter referred to as a gap) may deviate from a desired value due to the swelling of the certain area. When the gap deviates from the desired value, a landing position of ink in the recording operation deviates in the scanning direction. This deteriorates the quality of the image to be recorded on the sheet P.

Figure 10B:
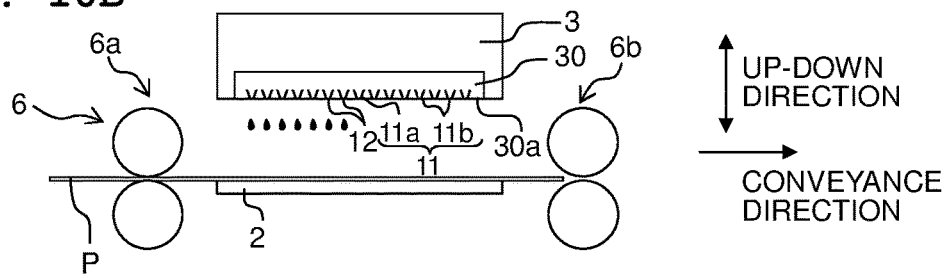
Figure 10C:
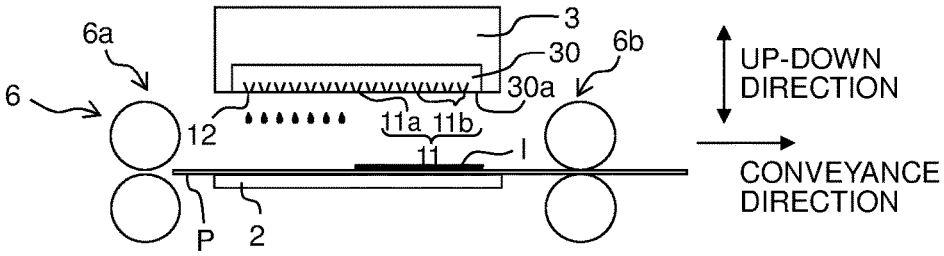

As depicted in FIGS. 10B and 10C, when the specified nozzles 11 are set, the discharge-defective nozzle 11*a* and all the nozzles 11*b* disposed at the downstream side in the conveyance direction from the discharge-defective nozzle 11*a* may be set as the specified nozzles 11. In this case, the nozzles 10 disposed at the upstream side in the conveyance direction from the discharge-defective nozzle 11*a* are set as the normally use nozzles 12.

Thus, in two continuous recording operations, when the later recording operation is executed after an image is recorded (see FIG. 10B) using the normally use nozzles 12 in the earlier recording operation, as depicted in FIG. 10C, the recording area I of the earlier recording operation is highly likely to be positioned at a position facing the head 30 without sandwiched by the conveyance roller pair 6*b*. Thus, the examples depicted in FIGS. 10B and 10C are relatively susceptible to the effect of the swelling of the recording area I of the earlier recording operation, and the gap is likely to deviate from the desired value, when the later recording operation is executed.

Figure 10D:
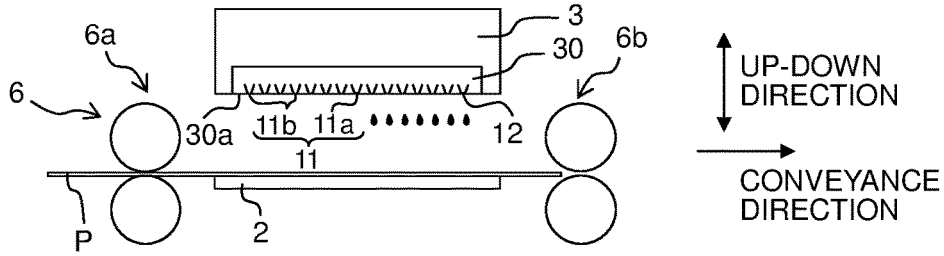
Figure 10E:
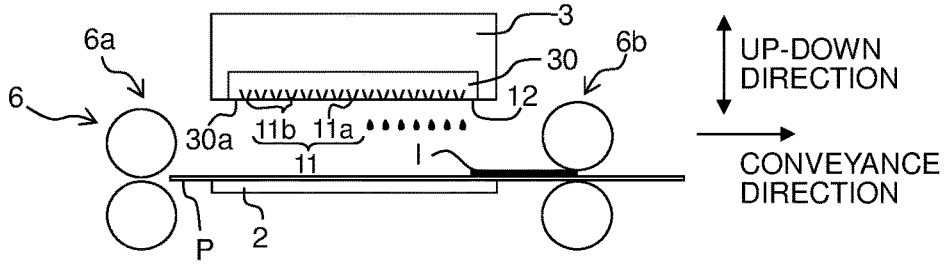

As depicted in FIGS. 10D and 10E, when the specified nozzles 11 are set, the discharge-defective nozzle 11*a* and all the nozzles 11*b* disposed at the upstream side in the conveyance direction from the discharge-defective nozzle 11*a* may be set as the specified nozzles 11. In this case, the nozzles 10 disposed at the downstream side in the conveyance direction from the discharge-defective nozzle 11*a* are set as the normally use nozzles 12.

Thus, in two continuous recording operations, when the later recording operation is executed after an image is recorded (see FIG. 10D) using the normally use nozzles 12 in the earlier recording operation, as depicted in FIG. 10E, the recording area I of the earlier recording operation is highly likely to be sandwiched by the conveyance roller pair 6*b*. Thus, the examples depicted in FIGS. 10D and 10E are hardly susceptible to the effect of the swelling of the recording area I of the earlier recording operation, and the gap is not likely to deviate from the desired value, when the later recording operation is performed.

As described above, as depicted in FIG. 10A, the effect of the swelling of the sheet P is made to be small by uniformly setting the discharge-defective nozzle 11*a* and all the nozzles 11*b* disposed at the upstream side in the conveyance direction from the discharge-defective nozzle 11*a* as the specified nozzles 11. This inhibits the deterioration in quality of the image to be recorded on the sheet P.

As a modified example, a first value and a second value are calculated. The first value corresponds to the number of normally use nozzles 12 when the discharge-defective nozzle 11*a* and all the nozzles 11*b* disposed at the upstream side in the conveyance direction from the discharge-defective nozzle 11*a* are set as the specified nozzles 11. The second value corresponds to the number of normally use nozzles 12 when the discharge-defective nozzle 11*a* and all the nozzles 11*b* disposed at the downstream side in the conveyance direction from the discharge-defective nozzle 11*a* are set as the specified nozzles 11. When the second value is larger than the first value by a predefined value or more, the discharge-defective nozzle 11*a* and all the nozzles 11*b* disposed at the downstream side in the conveyance direction from the discharge-defective nozzle 11*a* are set as the specified nozzles 11. When the second value is not larger than the first value by the predefined value or more, the discharge-defective nozzle 11*a* and all the nozzles 11*b* disposed at the upstream side in the conveyance direction from the discharge-defective nozzle 11*a* may be set as the specified nozzles 11. This inhibits the time for the recording process from lengthening. Further, when the difference between the first value and the second value is small, the deterioration in quality of an image to be recorded on the sheet P can be inhibited by setting the discharge-defective nozzle 11*a* and all the nozzles 11*b* disposed at the upstream side in the conveyance direction from the discharge-defective nozzle 11*a* as the specified nozzles 11.

When the recording process can be executed by selecting a recording mode from among recording modes, a method of setting the specified nozzles 11 may be changed depending on the recording mode. For example, the recording process may be executed by selecting one of a normal recording mode and a high-speed recording mode of which recording speed is higher than the normal recording mode. In this case, when the normal recording mode is selected, the discharge-defective nozzle 11*a* and all the nozzles 11*b* disposed at the upstream side in the conveyance direction from the discharge-defective nozzle 11*a* are set as the specified nozzles 11. When the high-speed recording mode is selected, the discharge-defective nozzle 11*a* and all the nozzles 11*b* disposed at any one of the upstream side and the downstream side in the conveyance direction from the discharge-defective nozzle 11*a* may be set as the specified nozzles 11 so that the number of the normally use nozzles 12 that can be used in the recording operation is maximized.

Other modified examples are explained below.

In the above embodiment, when the discharge-defective nozzle 11*a* is used in the recording operation, and when ink is not required to be discharged from the discharge-defective nozzle 11*a*, the specified nozzles 11 are also used in the recording operation. The present disclosure, however, is not limited thereto. Namely, it may be configured so that the specific nozzles 11 are not used in all the recording operations regardless of whether ink is required to be discharged from the discharge-defective nozzle 11*a*.

In the above embodiment, when the discharge-defective nozzle 11*a* is used, the controller 100 determines whether ink is required to be discharged from the discharge-defective nozzle 11*a* for each recording operation. The present disclosure, however, is not limited thereto. For example, when the discharge-defective nozzle 11*a* is used in the recording of an image on one sheet P, the controller 100 may determine whether ink is not required to be discharged from the discharge-defective nozzle 11*a* in all the recording operations, or whether ink is required to be discharged from the discharge-defective nozzle 11*a* in at least one recording operation. When the controller 100 has determined that ink is not required to be discharged from the discharge-defective nozzle 11*a* in all the recording operations, not only the normally use nozzles 12 but also the specified nozzles 11 are used in all the recording operations. When the controller 100 has determined that ink is required to be discharged from the discharge-defective nozzle 11*a* in at least one recording operation, only the normally use nozzles 12 may be used in all the recording operations.

The controller 100 may determine, depending on the recording mode, whether the specified nozzles 11 are used in the recording operation. For example, the controller 100 can execute the recording process by selecting a monochrome recording mode in which only the black ink is used to execute recording or a color recording mode in which recording is executed using four color inks. Here, it is assumed that the nozzle row 9K does not include the discharge-defective nozzle 11*a* and at least any of the three nozzle rows 9Y, 9C, and 9M includes the discharge-defective nozzle 11*a*. In this case, when the monochrome recording mode is selected, the controller 100 may determine that the specified nozzles 11 are used in the recording operation. When the color recording mode is selected, the controller 100 may determine that the specified nozzles 11 are not used in the recording operation.

In the above embodiment, the difference in electrical potential between the head 30 and the detection electrode 61 is generated in the nozzle inspection process. The difference in electrical potential, however, may not be generated. Even when no difference in electrical potential is generated therebetween, ink discharged from the nozzle 10 is slightly charged when separated from the nozzle surface 30*a*. Thus, when the charged ink approaches the detection electrode 61 and lands thereon, the voltage signal output from the detection electrode 61 becomes higher than the reference voltage value. Thus, even when the difference in electrical potential between the head 30 and the detection electrode 61 is not generated, although the accuracy may be lower than the above embodiment, the discharge state of the nozzle 10 can be inspected.

In the above embodiment, the discharge-defective nozzle is the non-discharge nozzle from which ink can not be discharged. The present disclosure, however, is not limited thereto. For example, when the volume of ink discharged from the nozzle 10 decreases, the voltage value of the voltage signal output from the detection electrode 61 decreases by an amount corresponding thereto. Thus, when the threshold value of the determination circuit 63 is set appropriately, it is possible to determine the nozzle 10 from which ink having a desired volume can not be discharged. Thus, not only the non-discharge nozzle but also the nozzle from which the ink having the desired volume can not be discharged may be determined as the discharge-defective nozzles.

The method of obtaining the discharge-defective nozzle information is not limited to that of the above embodiment. For example, a detection electrode extending in the up-down direction may be provided in the printer 1, and whether the nozzle 10 is the discharge-defective nozzle may be determined using a voltage value of the detection electrode when the ink discharged from the nozzle 10 passes through an area facing the detection electrode. Or, an optical sensor that detects the ink discharged from the nozzle 10 may be provided in the printer 1, and whether the nozzle 10 is the discharge-defective nozzle may be determined based on a detection result of the optical sensor. For example, slimier to the description of Japanese Patent No. 4,929,699, a voltage detection circuit that detects a change in voltage when ink is discharged from the nozzle may be connected to a plate on which the nozzles of the ink-jet head are formed, and a signal that varies depending on whether or not the nozzle 10 is the discharge-defective nozzle may be output from the voltage detection circuit to the controller 100. For example, as described in Japanese Patent Application Laid-open No. 2010-069872, a detection apparatus using a laser light may obtain discharge-defective nozzle information. Namely, the laser light emitted from a laser emitting portion is positioned to face the nozzle. The discharge-defective nozzle information may be obtained by using a phenomenon in which the laser light emitted from the laser emitting portion is blocked by the ink normally discharged from the nozzle, based on a light receiving result of a laser light receiving portion that receives the laser light emitted from the laser emitting portion. Further, the discharge-defective nozzle information may be obtained by recording a test pattern that can detect the discharge-defective nozzle on a sheet, and then causing a scanner to read the recording result or allowing a user to input the recording result.

In the above embodiment, the controller 100 obtains the information about the discharge-defective nozzles 11*a* of the four nozzle rows 9, as the discharge-defective nozzle information. The present disclosure, however, is not limited thereto. For example, only the information about the discharge-defective nozzle(s) 11*a* in one of the four nozzle rows 9 may be obtained as the discharge-defective nozzle information. For example, when the black ink is a pigment ink and the remaining three color inks are dye inks, the black ink is typically more likely to thicken. Thus, the nozzles 10 belonging to the nozzle row 9K are more likely to become the discharge-defective nozzles 11*a* than the nozzles 10 belonging to the nozzle rows 9Y, 9C, and 9M. The controller 100 may thus obtain only the information about the discharge-defective nozzle(s) 11*a* belonging to the nozzle row 9K as the discharge-defective nozzle information.

In the conveyance operation performed between two continuous recording operations of this embodiment, the sheet P is conveyed so that the scanning area $K_p$ of the earlier recording operation and the scanning area $K_L$ of the later recording operation are arranged adjacent to each other in the conveyance direction without overlapping with each other. The present disclosure, however, is not limited thereto. For example, the sheet P may be conveyed in the conveyance operation so that the scanning area $K_p$ of the earlier recording operation in the two continuous recording operations and the scanning area $K_L$ of the later recording operation in the two continuous recording operations partially overlap with each other.

In the above embodiment, the conveyance system of the sheet P of the conveyer is a roller conveyance system using the conveyance roller pairs. The present disclosure, however, is not limited thereto. The conveyance system may be any other conveyance system. For example, the conveyance system may be a belt conveyance system using a conveyance belt. In the belt conveyance system, the sheet P may be conveyed while being attracted to the conveyance belt. The attraction method of the sheet P is exemplified, for example, by an electrostatic attraction method in which static electricity is generated on a surface of the conveyance belt to attract the sheet P and an air attraction method in which through holes passing the conveyance belt in a thickness direction are provided to suction air through the through holes and to attract the sheet P.

The conveyance system of the conveyer may be a system in which the sheet P is conveyed using both the conveyance roller pairs and the conveyance belt. The recording medium may be a roll of paper that is continuous paper wound like a roll. In this case, the conveyer may include a winding mechanism that winds the roll of paper at a downstream side in the conveyance direction with respect to the ink-jet head (carriage).

The explanation is made about examples in which the present disclosure is applied to the printer that records an image on a sheet by discharging ink from nozzles. The present disclosure, however, is not limited thereto. The present disclosure is applicable to a liquid discharge apparatus that discharges liquid on any other recording medium than the sheet P. For example, the recording medium may be a T-shirt, a sheet for out-of-home advertising, and the like. The present disclosure can be applied to a liquid discharge apparatus that performs recording on a trace (wiring) board by discharging any other liquid than ink, such as a material of a trace (wiring) pattern. The present disclosure can be applied to a liquid discharge apparatus that performs recording on a medium, such as cases of mobile terminals including smartphones, cardboard, and resin, by discharging ink thereon.

What is claimed is:

1. A liquid discharge apparatus, comprising:

a conveyer configured to convey a recording medium in a conveyance direction, a head including a nozzle row in which a plurality of nozzles are arranged in the conveyance direction, a carriage carrying the head and configured to reciprocate in a scanning direction intersecting with the conveyance direction, and a controller configured to:

record an image on the recording medium by executing a recording operation, in which a liquid is discharged from the nozzles of the head based on image data during movement in the scanning direction of the carriage, and a conveyance operation in which the recording medium is conveyed by the conveyer in the conveyance direction, obtain discharge-defective nozzle information about a discharge-defective nozzle that is included in the nozzle row and of which discharge performance is lower than a predefined discharge performance, set, as a plurality of specified nozzles, the discharge-defective nozzle included in the nozzle row and all the nozzles disposed at an upstream side in the conveyance direction from the discharge-defective nozzle in the nozzle row, or the discharge-defective nozzle included in the nozzle row and all the nozzles disposed downstream of the discharge-defective nozzle in the conveyance direction in the nozzle row, based on the discharge-defective nozzle information obtained, and use another nozzle than the specified nozzles that is included in the nozzle row in the recording operation, in a case that the image is recorded.

2. The liquid discharge apparatus according to claim 1, wherein the controller is configured to control the head, the conveyer, and the carriage to alternatingly execute the recording operation and the conveyance operation, in the case that the image is recorded on the recording medium.

3. The liquid discharge apparatus according to claim 1, wherein the predefined discharge performance is one of a discharge performance as to whether an ink droplet of a predetermined size can be discharged, a discharge performance as to whether the ink droplet can be discharged at a predetermined speed, and a discharge performance as to whether the ink droplet can be discharged in a predetermined direction.

4. The liquid discharge apparatus according to claim 1, wherein, in the case that the controller sets the specified nozzles, the controller is configured to set the specified nozzles such that the number of nozzles usable in the recording operation is maximized.

5. The liquid discharge apparatus according to claim 1, wherein the conveyer includes a conveyance roller pair that is disposed downstream of the head in the conveyance direction and configured to convey the recording medium in the conveyance direction while nipping the recording medium, in the case that the controller sets the specified nozzles, the controller is configured to set, as the specified nozzles, the discharge-defective nozzle included in the nozzle row and all the nozzles disposed upstream of the discharge-defective nozzle in the conveyance direction in the nozzle row.

6. The liquid discharge apparatus according to claim 1, wherein in the case that the controller records the image, the controller is configured to:

determine based on the image data whether the liquid is required to be discharged from the discharge-defective nozzle, in a case that the discharge-defective nozzle is used in the recording operation, use a part of the nozzles excluding the specified nozzles in the recording operation, in a case that the controller has determined that the liquid is required to be discharged from the discharge-defective nozzle, and use another part of the nozzles including the specified nozzles in the recording operation, in a case that the controller has determined that the liquid is not required to be discharged from the discharge-defective nozzle.

7. The liquid discharge apparatus according to claim 6, wherein in the case that the controller records the image, the controller is configured to:

execute the recording operation a plurality of times for the recording medium, the recording operation including a plurality of recording operations, determine based on the image data whether the liquid is required to be discharged from the discharge-defective nozzle in at least one recording operation included in the recording operations, use a part of the nozzles excluding the specified nozzles in all the recording operations, in a case that the controller has determined that the liquid is required to be discharged from the discharge-defective nozzle in the at least one recording operation, and use another part of the nozzles including the specified nozzles in all the recording operations, in a case that the controller has determined that the liquid is not required to be discharged from the discharge-defective nozzle in all the recording operations.

8. The liquid discharge apparatus according to claim 1, wherein in the case that the controller records the image, the controller is configured to:

execute the recording operation a plurality of times, the recording operation including a plurality of recording operations, determine based on the image data whether the liquid is required to be discharged from the discharge-defective nozzle, in a case that the discharge-defective nozzle is used in each of the recording operations, use a part of the nozzles not including the specified nozzles in a recording operation included in the recording operations and determined that the liquid is required to be discharged from the discharge-defective nozzle, and use another part of the nozzles including the specified nozzles in a recording operation included in the recording operations and determined that the liquid is not required to be discharged from the discharge-defective nozzle.

9. The liquid discharge apparatus according to claim 1, wherein, in the conveyance operation executed between two continuous recording operations included in a plurality of recording operations, the controller is configured to control the conveyer to convey the recording medium such that scanning areas on the recording medium scanned by the nozzles used in the two continuous recording operations are adjacent to each other in the conveyance direction without overlapping with each other.

10. The liquid discharge apparatus according to claim 1, wherein in a case that the recording operation is executed by using any other nozzle than the specified nozzles, the controller is configured to control the head to execute non-discharge flushing of vibrating a meniscus formed in a target nozzle without discharging the liquid from the target nozzle, the target nozzle being one of the specified nozzles, but not being the discharge-defective nozzle.

11. The liquid discharge apparatus according to claim 1, wherein in a case that the recording operation is executed by using any other nozzle than the specified nozzles, the controller is configured to control the head to execute non-discharge flushing of vibrating meniscuses formed in plurality of target nozzles without discharging the liquid from the target nozzles, as the target nozzles being the specified nozzles.

12. The liquid discharge apparatus according to claim 9, wherein the head includes a liquid supply opening and a common channel extending from the liquid supply opening to each of the nozzles, a nozzle belonging to the nozzle row and disposed closer to an end in the conveyance direction has a longer length of the common channel from the liquid supply opening, the controller is configured to increase the number of execution times of the non-discharge flushing, in the case that the controller records the image, that the recording operation is executed by using a part of the nozzles not including the specified nozzles, and in a case that the target nozzle has a longer length of the common channel from the liquid supply opening.

13. The liquid discharge apparatus according to claim 1, wherein the nozzle row includes a first nozzle row from which a first liquid is discharged and a second nozzle row from which a second liquid, which is different from the first liquid, is discharged, the first nozzle row and the second nozzle row are arranged in the scanning direction, the controller is configured to:

obtain information about the discharge-defective nozzle included in the first nozzle row as the discharge-defective nozzle information, set the specified nozzles included in the first nozzle row based on the discharge-defective nozzle information obtained, and set, as the specified nozzles, a plurality of nozzles included in the second nozzle row and having positions in the conveyance direction that are identical to positions in the conveyance direction of the specified nozzles included in the first nozzle row.

14. The liquid discharge apparatus according to claim 13, wherein the controller is configured to determine based on the image data whether the liquid is required to be discharged from the discharge-defective nozzle included in the first nozzle row, in a case that the discharge-defective nozzle included in the first nozzle row is used in the recording operation, in a case that the controller has determined that the liquid is required to be discharged from the discharge-defective nozzle included in the first nozzle row, the controller is configured to use a part of the nozzles included in the first nozzle row and the second nozzle row and excluding the specified nozzles in the recording operation, and in a case that the controller has determined that the liquid is not required to be discharged from the discharge-defective nozzle included in the first nozzle row, the controller is configured to use another part of the nozzles included in the first nozzle row and the second nozzle row and including the specified nozzles in the recording operation.

15. The liquid discharge apparatus according to claim 1, further comprising a detection apparatus configured to detect the discharge-defective nozzle belonging to the nozzle row, wherein the controller is configured to obtain a detection result of the detection apparatus as the discharge-defective nozzle information.

* * * * *